US010358951B2

(12) United States Patent
Liskar et al.

(10) Patent No.: US 10,358,951 B2
(45) Date of Patent: Jul. 23, 2019

(54) SLIDING CONTACT FOR ELECTRICALLY ACTUATED ROCKER ARM

(71) Applicant: Eaton Corporation, Cleveland, OH (US)

(72) Inventors: Petr Liskar, Prague (CZ); Jiri Cecrle, Prague (CZ); Dale Arden Stretch, Novi, MI (US); Michael J. Campbell, Scotts, MI (US); Tomas Drabek, Prague (CZ); James Edward McCarthy, Kalamazoo, MI (US); Austin Robert Zurface, Hastings, MI (US); Robert Philip Benjey, Dexter, MI (US); Eric John Yankovic, Augusta, MI (US); Brian Karl Vandeusen, Augusta, MI (US); Nicholas Peter Gillette, Ceresco, MI (US); Michael James Stanton, Hastings, MI (US); Thomas Michael Tembreull, Homer, MI (US); Anthony Leon Spoor, Union City, MI (US)

(73) Assignee: Eaton Intelligent Power Limited, Dublin (IE)

( * ) Notice: Subject to any disclaimer, the term of this patent is extended or adjusted under 35 U.S.C. 154(b) by 6 days.

(21) Appl. No.: 15/863,901

(22) Filed: Jan. 6, 2018

(65) Prior Publication Data

US 2018/0142583 A1 May 24, 2018

Related U.S. Application Data

(63) Continuation-in-part of application No. 15/503,458, filed on Feb. 13, 2017, now Pat. No. 10,180,089, and (Continued)

(51) Int. Cl.
*F01L 1/18* (2006.01)
*F01L 1/22* (2006.01)

(Continued)

(52) U.S. Cl.
CPC ..... *F01L 1/22* (2013.01); *F01L 1/053* (2013.01); *F01L 1/181* (2013.01); *F01L 1/185* (2013.01);

(Continued)

(58) Field of Classification Search
CPC ... F01L 1/185; F01L 2001/186; F01L 1/2405; F01L 1/46; F01L 2009/0403;

(Continued)

(56) References Cited

U.S. PATENT DOCUMENTS 3,040,217 A 6/1959 Conrad
4,203,397 A 5/1980 Soeters, Jr.

(Continued)

FOREIGN PATENT DOCUMENTS

EP 2050933 A1 4/2009

*Primary Examiner* — Jorge L Leon, Jr.
(74) *Attorney, Agent, or Firm* — Paul V. Keller

(57) ABSTRACT

A valvetrain for an internal combustion engine of the type that has a combustion chamber, a moveable valve having a seat formed in the combustion chamber, and a camshaft includes a rocker arm assembly, a pivot providing a fulcrum for a rocker arm of the rocker arm assembly, and a latch assembly. An electrical device mounted to the rocker arm assembly receives power or communicates through a circuit that includes an electrical connection formed by abutment between surfaces of two distinct parts. The rocker arm assembly is operative to move one of the two abutting surfaces relative to the other in response to actuation of the cam follower. Forming an electrical connection through abutting surfaces that are free to undergo relative motion (Continued)

may reduce or eliminate the need to run wires to a mobile portion of the rocker arm assembly.

26 Claims, 34 Drawing Sheets

Related U.S. Application Data a continuation-in-part of application No. PCT/US2016/063730, filed on Nov. 24, 2016.

(60) Provisional application No. 62/503,303, filed on May 8, 2017, provisional application No. 62/488,747, filed on Apr. 22, 2017, provisional application No. 62/449,174, filed on Jan. 23, 2017, provisional application No. 62/305,612, filed on Mar. 9, 2016, provisional application No. 62/259,764, filed on Nov. 25, 2015.

(51) Int. Cl.

| | |
|---|---|
| ***F01L 1/053*** | (2006.01) |
| ***F01L 13/00*** | (2006.01) |
| ***F01L 1/24*** | (2006.01) |
| ***F01L 3/24*** | (2006.01) |

(52) U.S. Cl.
CPC ..... *F01L 1/2405* (2013.01); *F01L 3/24* (2013.01); *F01L 13/0005* (2013.01); *F01L 13/0036* (2013.01); *F01L 2001/0535* (2013.01); *F01L 2001/186* (2013.01); *F01L 2013/001* (2013.01); *F01L 2013/101* (2013.01); *F01L 2105/00* (2013.01); *F01L 2201/00* (2013.01)

(58) Field of Classification Search
CPC ..... F01L 2009/0421; F01L 2009/0446; F01L 2009/0448; F01L 2009/0463; F01L 13/0005; F01L 2820/031
USPC ..... 123/90.11, 90.41, 90.43, 90.44, 90.46
See application file for complete search history.

(56) References Cited

U.S. PATENT DOCUMENTS

| | | | | |
|---|---|---|---|---|
| 5,544,626 | A * | 8/1996 | Diggs | F01L 1/185 123/198 F |
| 5,896,076 | A | 4/1999 | van Namen | |
| 6,318,318 | B1 | 11/2001 | Jahr | |
| 2008/0006232 | A1 | 1/2008 | Gregor et al. | |
| 2008/0127917 | A1 * | 6/2008 | Riley | F01L 1/185 123/90.11 |

* cited by examiner

SLIDING CONTACT FOR ELECTRICALLY ACTUATED ROCKER ARM

PRIORITY

The present application claims priority from U.S. Provisional Patent Application No. 62/259,764 filed Nov. 25, 2015, U.S. Provisional Patent Application No. 62/305,612 filed Mar. 9, 2016, PCT Application PCT/US16/63730, filed Nov. 24, 2016, U.S. Provisional Patent Application No. 62/449,174, filed Jan. 23, 2017, U.S. patent application Ser. No. 15/503,458, filed Feb. 13, 2017, U.S. Provisional Patent Application No. 62/488,747, filed Apr. 22, 2017, and U.S. Provisional Patent Application No. 62/503,303, filed May 8, 2017, which applications are incorporated by reference in their entireties.

FIELD

The present teachings relate to valvetrains, particularly valvetrains providing variable valve lift (VVL) or cylinder deactivation (CDA).

BACKGROUND

Hydraulically actuated latches are used on some rocker arm assemblies to implement variable valve lift (VVL) or cylinder deactivation (CDA). For example, some switching roller finger followers (SRFF) use hydraulically actuated latches. In these systems, pressurized oil from an oil pump may be used for latch actuation. The flow of pressurized oil may be regulated by an oil control valve (OCV) under the supervision of an engine control unit (ECU). A separate feed from the same source provides oil for hydraulic lash adjustment. In these systems, each rocker arm assembly has two hydraulic feeds, which entails a degree of complexity and equipment cost.

The oil demands of these hydraulic feeds may approach the limits of existing supply systems. The complexity and demands for oil in some valvetrain systems can be reduced by replacing hydraulically latched rocker arm assemblies with electrically latched rocker arm assemblies. Electrically latched rocker arm assemblies require power.

SUMMARY

The present teachings relate to powering or communicating with an electronic device such as a solenoid that is mounted to a mobile portion of a rocker arm assembly such as a rocker arm. If the electronic device is powered with conventional wiring, it is a possible for a wire to be caught, clipped, or fatigued and consequently short out. The present teachings provide a valvetrain suitable for an internal combustion engine that includes a combustion chamber, a moveable valve having a seat formed within the combustion chamber, and a camshaft. The valvetrain includes a rocker arm assembly. The rocker arm assembly includes a rocker arm, a cam follower configured to engage a camshaft-mounted cam as the camshaft rotates, and an electrical device mounted to the rocker arm.

According to some aspects of the present teachings, an electrical circuit that of which the electrical device is a part includes a connection formed by abutment between the surfaces of two distinct parts. The rocker arm assembly is operative to move one of the two abutting surfaces relative to the other in response to actuation of the cam follower. The abutting surfaces of the two distinct parts may be electrically isolated from ground, whereby the connection may be used for powering or communicating with the electrical device. The ground may correspond to a cylinder head of an engine in which the valvetrain is installed. Forming the connection through abutting surfaces that are free to undergo relative motion may reduce or eliminate the need to run wires between parts that undergo relative motion.

According to some aspects of the present teachings, one of the two distinct parts forming the electrical connection is mounted to the rocker arm assembly and the other is not. In some of these teachings the part mounted to the rocker arm assembly is mounted to the rocker arm on which the electrical device is mounted. In some of these teachings, the part not mounted to the rocker arm assembly is mounted to a frame that has a base that fits against a pivot that provides a fulcrum for the rocker arm assembly. In some of these teachings, the frame fits around a pivot that provides a fulcrum for the rocker arm assembly. In some of these teachings, the frame also rests against a cylinder head in which the combustion chamber is formed. In some of these teachings, the frame rests against the cylinder head at a point on the cylinder head that is higher above the combustion chamber than the rocker arm assembly and at a point on the cylinder head that is less high above the combustion chamber than the rocker arm assembly. In some of these teachings, the part not mounted to the rocker arm assembly is mounted to a frame that has a base that abuts two or more pivots that provide fulcrums for rocker arm assemblies of the valvetrain.

In some of these teachings, one of the two distinct parts that forms the electrical connection is mounted to the rocker arm and the other is mounted to a pivot providing a fulcrum for that rocker arm. In some of these teachings, the pivot is a lash adjuster, such as a hydraulic lash adjuster. Mounting the one part to the rocker arm and the other to the pivot or in abutment with the pivot may facilitate positioning the two parts forming the electrical connection relative to one another. The part mounted to the pivot may be connected to an engine electrical system through wires that undergo relatively little motion.

According to some aspects of the present teachings, a load-bearing member of the valvetrain forms part of the electrical circuit. In some of these teachings, the portion of the load-bearing structure that forms a portion of the electrical circuit is isolated from ground. In some of these teachings, the load-bearing structure is a pivot. In some of these teachings, the load-bearing structure is a cam. In some of these teachings, the load-bearing structure is a cam follower. In some of these teachings, the electrical connection is formed at a load-bearing interface between two structures of the valvetrain.

In some of these teachings, the electrical device is powered through the electrical circuit. In some of these teachings, the electrical device is an electromagnetic latch assembly. In some of these teachings, the electrical device communicates with a processor through the electrical circuit. In some of these teachings, the electrical device is a sensor.

According to some aspects of the present teachings, one of the two distinct parts forming the electrical connection is mounted to the rocker arm bearing the electrical device and the rocker arm is operative to pivot in response to actuation of the cam follower by a camshaft-mounted cam. The pivoting is operative to cause one of the two distinct parts to move relative to the other. In some of these teachings, the electrical connection is made proximate the axis of pivoting. Forming the connection near the axis of pivoting keeps motion between the two distinct parts comparatively small. In some of these teachings, one of the parts forming the electrical connection is mounted over a spring post on the rocker arm. The spring post may be located proximate the axis of pivoting.

In some of these teachings, one of the surfaces forming the electrical connection is oriented parallel to a plane to which the axis of pivoting is perpendicular. In some of these teachings, at least one of the two part surfaces forming the electrical connection is relatively flat and has a surface normal vector that is substantially parallel to the axis of pivoting. In some of these teachings the surface normal vector is nearly perpendicular to a direction in which a lash adjuster extends to adjust lash.

In some others of these teachings, one of the two part surfaces has a surface normal vector that points approximately toward or directly away from the axis about which the pivoting occurs. In some of these other teachings, one of the two part surfaces has a radius of curvature that is approximately equal to the surface's distance from the axis about which the pivoting occurs. The foregoing structures may facilitate maintaining contact between the two distinct parts forming the electrical connection even as the parts undergo relative motion due to pivoting of the rocker arm.

According to some aspects of the present teachings, one of the two distinct parts is a contact held to a side of the rocker arm by a contact frame that is supported within an opening at the back of the rocker arm. In some of these teaching, the contact frame is secured to the sides of the rocker arm as well.

In some aspects of these teachings, one of the two part surfaces forming the electrical connection is a projecting conductive member. The projecting conductive member may be rigid. For example, the projecting conductive member may be a metal pin projecting outward from a rocker arm. In some of these teachings, the projecting conductive member projects outward from a rocker arm parallel or nearly parallel to an axis on which the rocker arm pivots. In some of these teachings, the projecting conductive member is mounted to the rocker arm and is located proximate an axis on which the rocker arm pivots.

The surfaces forming the electrical connection may be exposed to the environment of the rocker arm assembly and may become coated with a thin layer of engine oil. In some of these teachings, the rocker arm assembly is operative to cause the surface of one of the two distinct parts to slide over the other. In some of these teachings, one of the parts is a brush. Brushes may have the effect of pushing oil from between the abutting surfaces of the two distinct parts. In some of these teachings, one of the two distinct parts is configured to roll over the other. Rolling contact may have the advantage of reduced wear.

According to some aspects of the present teachings, a lash adjuster provides a fulcrum on which the rocker arm assembly pivots. In some of these teachings, one of the surfaces forming the electrical connection runs parallel to a direction in which the lash adjuster extends to adjust lash. In some of these teachings, the surfaces of the two distinct parts forming the electrical connection are configured to slide one past the other while remaining in contact as the lash adjuster extends and retracts to adjust lash. In some of these teachings, the lash adjuster is a hydraulic lash adjuster and the surfaces of the two distinct parts forming the electrical connection are configured to maintain the electrical connection as the lash adjuster extends and retracts between pumped up and depressurized states. These structures facilitate maintaining contact between the two distinct parts even as one of the parts is moved relative to the other as a result of lash adjustment.

According to some aspects of the present teachings, the valvetrain includes a spring biasing one of the two distinct parts whose abutting surfaces form the electrical connection against the other. In some of these teachings the spring itself forms part of the electrical circuit. The spring may facilitate good contact and compensate for wear. In some of these teachings, one of the parts is a pogo pin connector. In some of these teachings, the spring is a leaf spring. In some of these teachings, an end of the leaf spring is held stationary relative to the combustion chamber.

According to some aspects of the present teachings, the electrical connection is made within an interface between load-bearing members of the valvetrain. In some of these teachings, the electrical circuit is completed by a mechanical interface between two load bearing structures of the valvetrain. In some of these teachings, one of the two parts forming the electrical connection includes an insulating structure surrounding the surface through which the electrical connection is made. In some of these teachings the connection is made within an area of contact between a lash adjuster and a rocker arm. Forming the connection within a load-bearing interface keeps the connection within a volume already occupied by the rocker arm assembly.

According to some aspects of the present teachings, one of the two distinct parts forming the electrical connection is a conductor integrated into the structure of a load-bearing member of the valvetrain. In some of these teachings, the conductor is a conductive trace formed on a surface of the load-bearing member. In some of these teachings, the load-bearing member is a valve stem. In some of these teachings, the load-bearing member is a pivot.

In some of these teachings, the electrical device is an electromagnetic latch assembly having a latch pin translatable between a first position and a second position. One of the first and second latch pin positions provides a configuration in which the rocker arm assembly is operative to actuate a moveable valve in response to actuation of the cam follower by a camshaft-mounted cam to produce a first valve lift profile. The other of the first and second latch pin positions provides a configuration in which the rocker arm assembly is operative to actuate the moveable valve in response to actuation of the cam follower by the camshaft-mounted cam to produce a second valve lift profile, which is distinct from the first valve lift profile, or the moveable valve is deactivated. This structure may provide cylinder deactivation (CDA) or variable valve lift (VVL).

In some of these teachings, the electromagnetic latch assembly include a coil operable to actuate the latch pin between the first and second positions. In some of these teachings the electromagnetic latch assembly provides the latch pin with positional stability independently from the coil when the latch pin is in the first position and when the latch pin is in the second position. In some of these teachings, the electromagnetic latch assembly is operable with a DC current in a first direction to actuate the latch pin from the first position to the second positions and with a DC current in a second direction, which is a reverse of the first, to actuate the latch pin from the second position to the first position. Having the electromagnetic latch assembly make the latch pin stable without power in both the first and the second positions allows the electrical connection to be broken without the latch pin position changing.

According to some aspects of the present teachings, the rocker arm assembly is operative to cyclically break or vary the resistance of the electrical connection in relation to actuation of the cam follower. In some of these teachings, an internal combustion engine includes circuitry operative to determine the status of the electrical connection. The status of the electrical connection provides information that may be used to provide diagnostic feedback or to guide an engine control.

In some of these teachings, a surface of one of the parts forming the electrical connection is partially coated with a material that increases electrical resistance and the valvetrain is operable to move the area of contact between the two distinct parts between the coated surface and an uncoated surface, whereby the resistance of the connection varies in conjunction with rocker arm motion. In some of these teachings, one of the two distinct parts is operative to form a second electrical connection over a period when it is not forming the first electrical connection. In some of these teachings, the engine includes circuitry operative to determine the status of the second electrical connection. Determinations of the statuses of the first and second electrical connections may provide information that can be used to perform an engine management or diagnostic operation. In some of these teachings, one of these structures is used to perform an onboard diagnostic, which may result in a diagnostic report. In some of these teachings, one of these structures is used to provide information relating to whether the rocker arm is lifted at one or more particular times and an engine management operation is performed on the basis of that information.

Additional aspects of the invention relate to methods of powering or communicating with an electrical device mounted to a rocker arm assembly. The method includes powering or communicating with the electrical device through an electrical circuit that includes an electrical connection formed by abutment between the surfaces of two distinct parts and operating the rocker arm assembly in such a way that the surfaces move relative to one another. In some of these teachings, the electrical connection is preserved throughout operation of the rocker arm assembly. In some of these teachings, the electrical connection is episodically broken.

In some aspects of the present teachings, the rocker arm has external wiring that runs from the side of the rocker arm to the back of the rocker arm. A portion of an electromagnetic latch assembly including a coil may be installed in the rocker arm through the opening at the back. A latch pin may extend out of the rocker arm at the opposite side from the opening. In some of these teachings, wiring to the coil passes through the opening in the back of the rocker arm. In some of these teachings, external wiring running from the back of the rocker arm to the side of the rocker arm is supported by a part that is mounted within the opening in the back of the rocker arm. In some of these teachings, the part is press fit within that opening. In some of these teachings, the part is formed by over-molding the wiring. In some of these teachings, the part holds contact pads to the sides of the rocker arm. An electrical connection to the rocker arm may be made through the contact pads. The contact pads may have contact surfaces oriented in a plane. Rocker arm motion may be limited to directions all of which lie in a plane parallel to the plane in which the contact pads are oriented.

According to some aspects of the present teachings, the rocker arm assembly includes a pivot and a wiring connection to the rocker arm is made from a wiring harness that abuts the pivot. The pivot may be a hydraulic lash adjuster. Abutment with the pivot facilitates correct positioning of the wiring harness and connectors between the wiring harness and the rocker arm. In some of these teachings, the wiring harness abuts a plurality of pivots and provides connections to rocker arms associated with each of those pivots.

According to some aspects of the present teachings, the valvetrain includes a wiring harness providing power to the valvetrain. In some of these teachings the wiring harness connects to the power system of a vehicle. In some of these teachings the wiring harness connects to a vehicle control system. In some of these teachings, a wiring connection to the vehicle is made proximate a spark plug tower. In some of these teachings, the wiring runs through the valve cover proximate the spark plug tower. In some of these teachings, the wiring runs into the spark plug tower below the valve cover and out of the spark plug tower above the valve cover.

In some of these teachings, the wiring harness is supported by a frame. In some of these teachings, the frame is plastic. In some of these teachings, the wiring harness include wires that are fully enclose in the plastic frame. In some of these teachings, wires fully enclosed in the plastic frame are formed by strips of metal. The plastic frame may protect the wiring from the surrounding environment, prevent the wiring from contacting moving parts, and prevent the wiring from being damaged during maintenance.

In some of these teachings, the frame rests on the cylinder head. In some of these teachings, the frame is secured to the cylinder head. The frame may maintain the wiring in proximity to the cylinder head, where the wiring is out of the way. In some of these teachings, the frame supports or incorporates towers that include spring loaded connectors that slide over contacts on the rocker arms to complete electrical circuits that power the electromagnetic latch assemblies.

In some of these teachings, the frame abuts a spark plug tower. In some of these teachings, the frame has a circular opening that fits around a spark plug tower. In some of these teachings, the frame fits closely around a spark plug tower. These features may be provided to help locate the frame.

In some of these teachings, the frame abuts a pivot that provides a fulcrum for a rocker arm assembly. In some of these teachings, the pivot is a lash adjuster. The lash adjuster may be a hydraulic lash adjuster. The frame may mount against the pivot. In some of these teachings, the location of the frame is secured by the pivot. In some of these teachings, the location of the frame is secured by both a pivot and a spark plug tower. The frame may be braced against the pivot and the spark plug tower. Locating the frame against a pivot may facilitate properly positioning wiring and contacts that complete circuits with electronic devices mounted to the pivot or the rocker arm assembly.

According to some aspects of the present teachings, an electrical device mounted to a rocker arm is connected through a circuit that includes a wire that runs through a pivot providing a fulcrum for the rocker arm. In some of these teachings, the wire enters the pivot through a port designed to admit hydraulic fluid into the pivot. In some of these teachings, the wire runs upward through a passage within the lash adjuster. In some of these teachings, the wire exits the lash adjuster at a port suitable for providing hydraulic fluid from the hydraulic lash adjuster to a rocker arm that pivots on the hydraulic lash adjuster. In some of these teachings, the wire further passes through a passage in the rocker arm. In some of these teachings, the wire enters a chamber in the rocker arm designed as a hydraulic chamber. In this way, a hydraulic lash adjuster and or a rocker arm designed for hydraulic latching may be adapted to electrical latching with minimum modification. Moreover, the hydraulic lash adjuster and or the rocker arm may provide protective conduits for the wires. These locations may also be ones where the wires undergo relatively little movement in comparison to wires running to other parts of the rocker arm assembly.

The primary purpose of this summary has been to present certain of the inventors' concepts in a simplified form to facilitate understanding of the more detailed description that follows. This summary is not a comprehensive description of every one of the inventors' concepts or every combination of the inventors' concepts that can be considered "invention". Other concepts of the inventors will be conveyed to one of ordinary skill in the art by the following detailed description together with the drawings. The specifics disclosed herein may be generalized, narrowed, and combined in various ways with the ultimate statement of what the inventors claim as their invention being reserved for the claims that follow.

DETAILED DESCRIPTION

Figure 1:
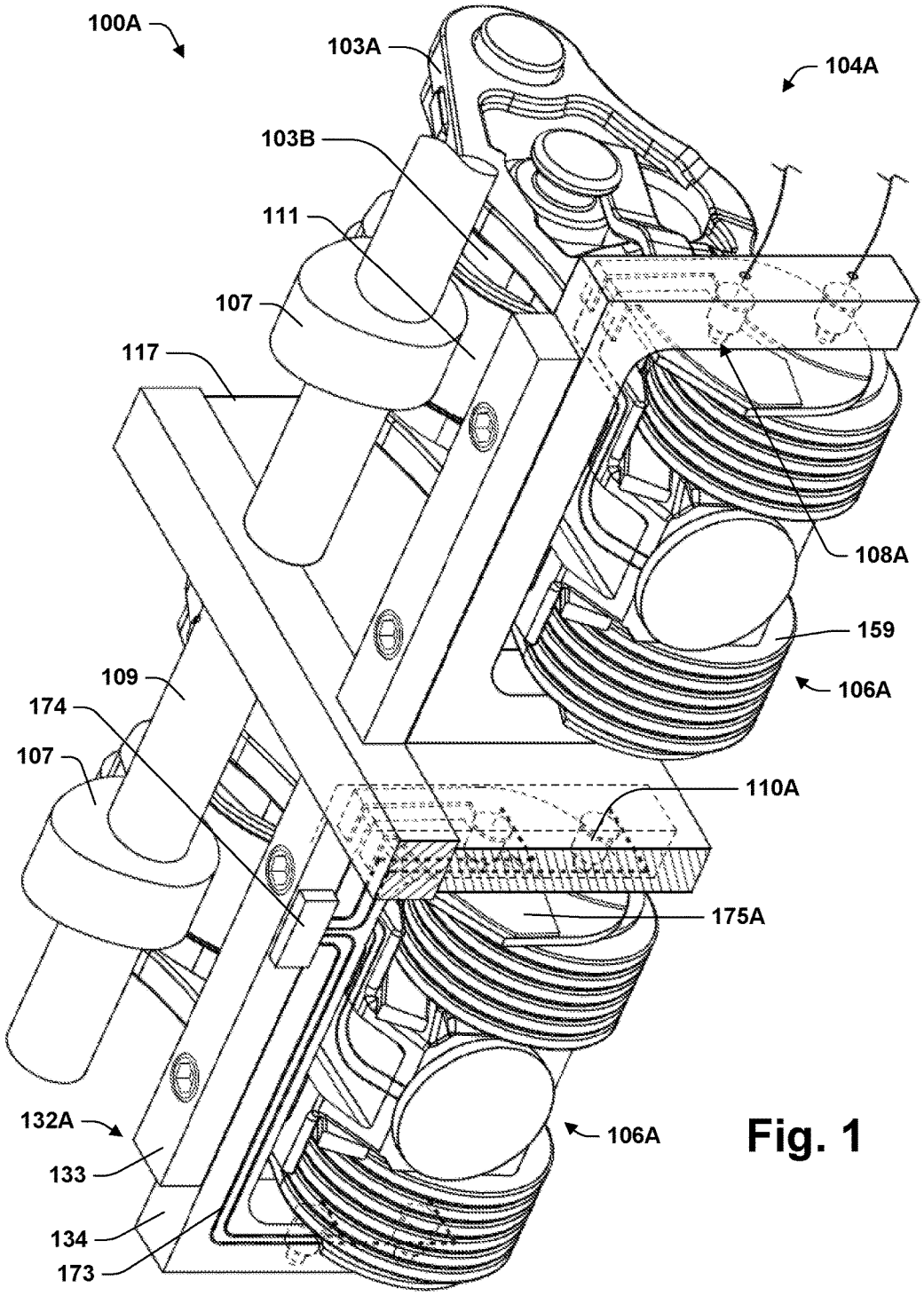
FIG. 1 is a perspective view of a portion of an internal combustion engine including a valvetrain according to some aspects of the present teachings.

In the drawings, some reference characters consist of a number followed by a letter. In this description and the claims that follow, a reference character consisting of that same number without a letter is equivalent to a listing of all reference characters used in the drawings and consisting of that same number followed by a letter. For example, "permanent magnet 200" is the same as "permanent magnet 200A, 200B". Permanent magnet 200 is therefore a generic reference that includes the specific instances permanent magnet 200A and permanent magnet 200B. Where options are provided for one instance subject to a generic reference, those options are to be given consideration in connection with all instances subject to that generic reference.

FIGS. 1-7 illustrate aspects an internal combustion engine 100A that includes a cylinder head 102 and valvetrain 104A in accordance with some of the present teachings. Referring to FIG. 1, internal combustion engine 100A may include a camshaft supporting member 117 and a camshaft 109 on which are mounted eccentrically shaped cams 107. Camshaft supporting member 117 may be a cam tower formed into a cylinder head. In some of these teachings, camshaft supporting member 117 is a cam carrier. Valvetrain 104A may include a plurality of rocker arm assemblies 106A and pivots 140. A mounting frame 132A may mount to camshaft supporting member 117 and hold pogo pins 110A adjacent and in abutment with contact pads 175A on rocker arm assemblies 106A. Mounting frame 132A may include two members that are fixed together: a first member 134 that mounts to camshaft supporting member 117 and a second member 133 that holds pogo pins 110A. Second member 134 may be made of plastic or another non-conductive material. A connection plug 174 may provide a convenient way to couple wires 173 from pogo pin connectors 110A to an electrical system of internal combustion engine 100A. Wires 173 and or connection plug 174 may also be attached to mounting frame 132A.

Figure 2:
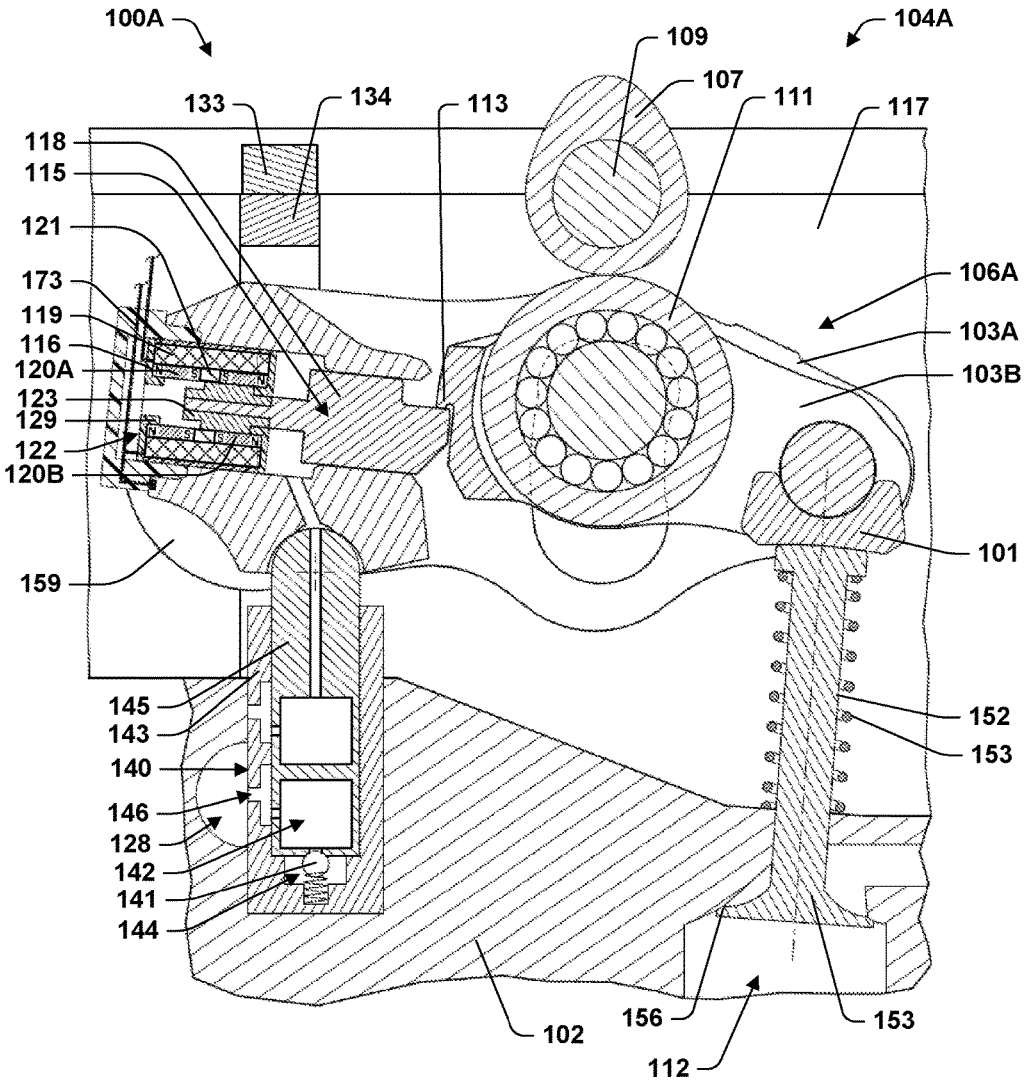
FIG. 2 is a cross-sectional view of a portion of the internal combustion engine of FIG. 1 with a cam on base circle.
Figure 3:
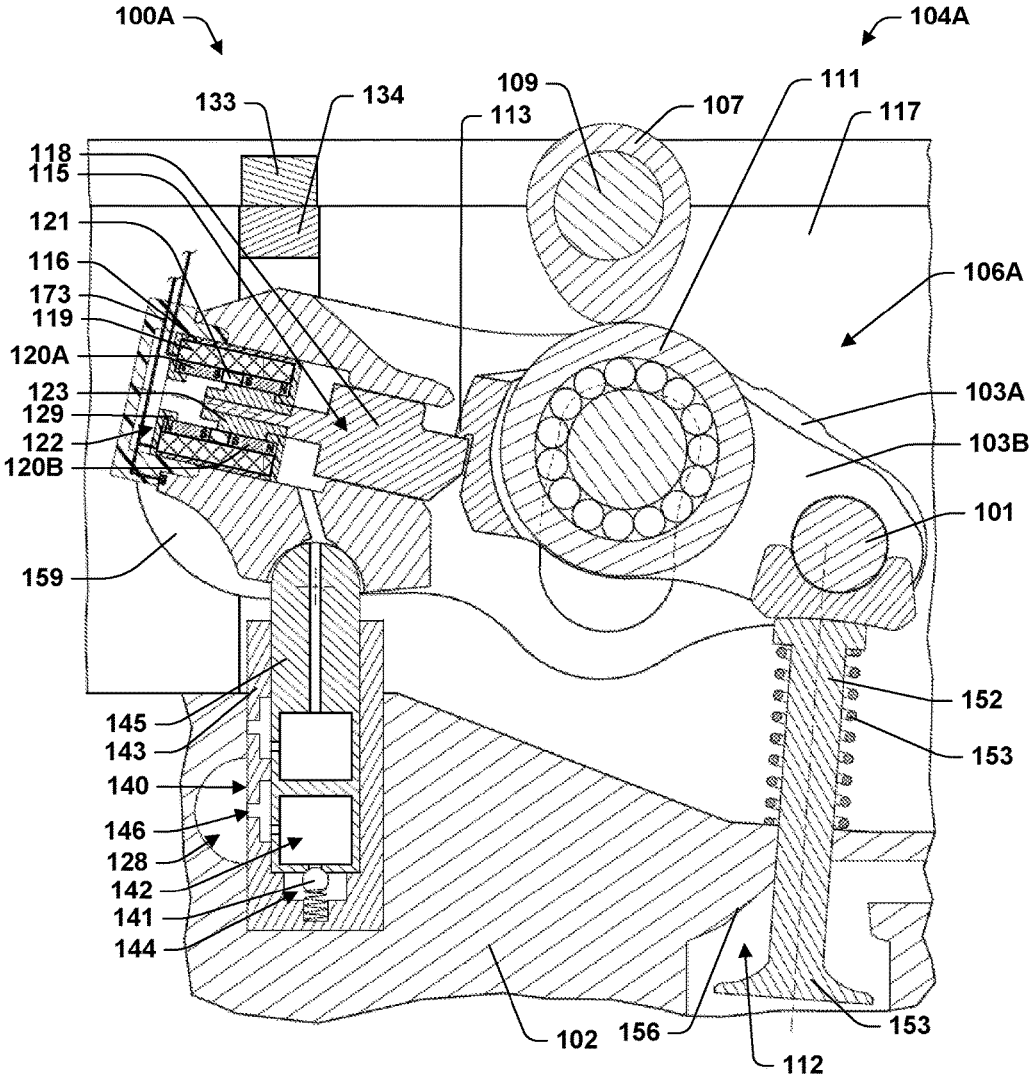
FIG. 3 is a cross-sectional view of a portion of the internal combustion engine of FIG. 1 with a rocker arm assembly in a latched stated and a cam off base circle.
Figure 4:
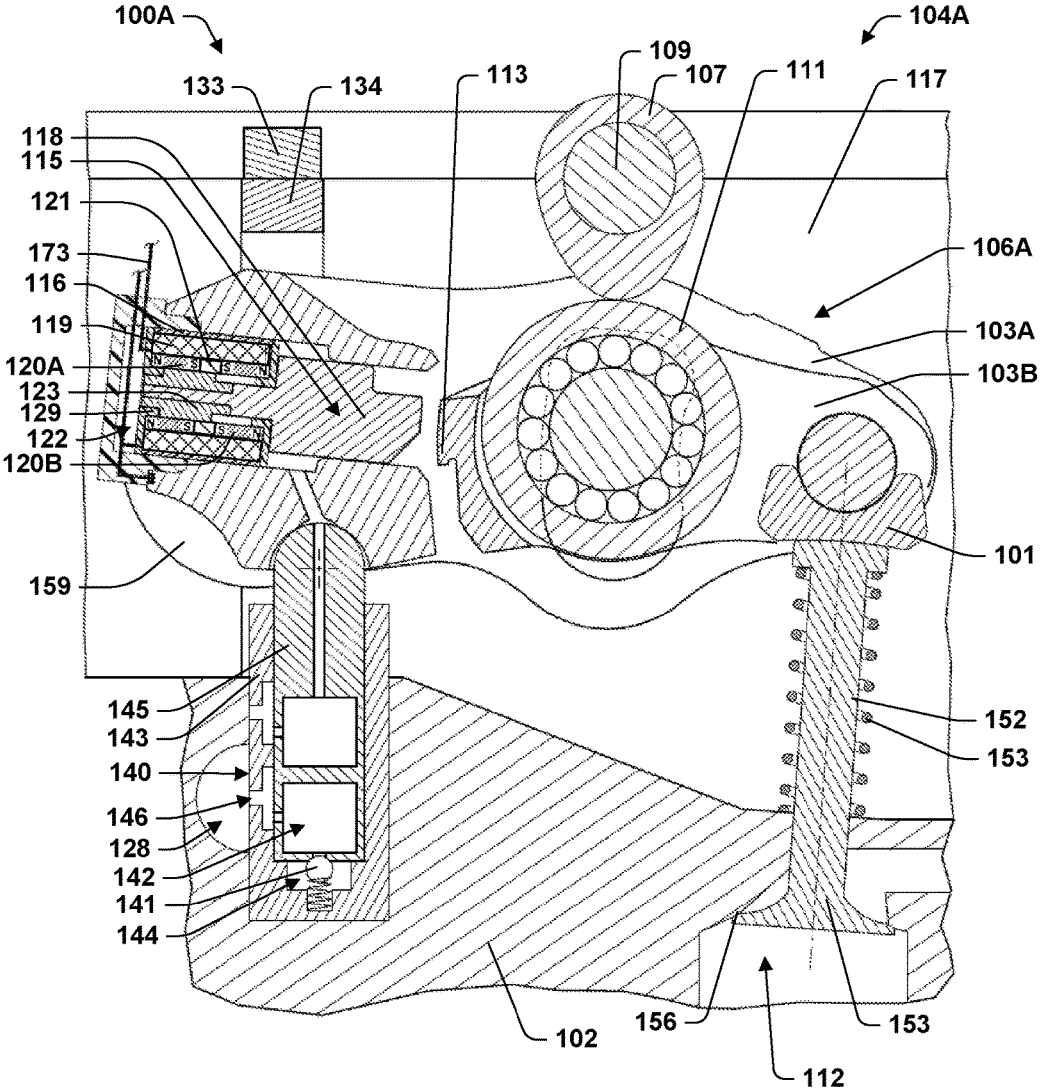
FIG. 4 is a cross-sectional view of a portion of the internal combustion engine of FIG. 1 with a rocker arm assembly in an unlatched stated with a cam off base circle.

With reference to FIGS. 2-4, internal combustion engine 100A may include a movable valve 152, such as a poppet valve, which has a seat 156 within a combustion chamber 112 formed within cylinder head 102. Rocker arm assembly 106A may include inner arm 103B and outer arm 103A. Pivots 140 may be a hydraulic lash adjusters. A hydraulic lash adjuster (HLA) 140 may include an inner sleeve 145 and an outer sleeve 143. A cam follower 111 may be mounted to inner arm 103B and be configured to engage a cam 107 on camshaft 109 as camshaft 109 rotates. Rocker arm assembly 106A is operative to transmit force from cam 107 to actuate valve 152. An electromagnetic latch assembly 122 may be mounted to outer arm 103A. Outer arm 103A is mobile relative to cylinder head 102.

Electromagnetic latch assembly 122 includes a coil 119. Coil 119 may be rigidly mounted with respect to outer arm 103A. Electromagnetic latch assembly 122 may include permanent magnets 120A and 120B, a latch pin 115, and a shell 116. Shell 116 may be made of a low coercivity ferromagnetic material such as soft iron. Permanent magnets 120A and 120B may be annular and arranged with confronting polarities and with a ring 121 of low coercivity ferromagnetic material between them. Latch pin 115 may include a latch head 118 and a low coercivity ferromagnetic portion 123. Low coercivity ferromagnetic portion 123 may be a sleeve on an otherwise paramagnetic latch pin 115. Latch pin 115 may be translatable between extended and retracted positions.

FIGS. 2 and 3 show latch pin 115 in the extended position. The extended position for latch pin 115 may be described as an engaging position and provides an engaging configuration for rocker arm assembly 106A. If cam 107 is rotated while latch pin 115 is in the engaging position, head 118 of latch pin 115 may engage lip 113 of inner arm 103B. The force of cam 107 on cam follower 111 may actuate cam follower 111 causing both inner arm 103B and outer arm 103A to pivot together on hydraulic lash adjuster 140, bearing down on valve 152 and compressing valve spring 153. Valve 152 may be lifted off its seat 156 as shown in FIG. 3 with a valve lift profile determined by the shape of cam 107. The valve lift profile is the shape of a plot showing the height by which valve 152 is lifted of its seat 156 as a function of angular position of camshaft 109. In the engaging configuration, camshaft 109 may do work on rocker arm assembly 106 as cam 107 rises off base circle. Much of the resulting energy may be taken up by valve spring 153 and returned to camshaft 109 as cam 107 descends back toward base circle.

If cam 107 is rotated while latch pin 115 is in the non-engaging position as shown in FIG. 4, the downward force on cam follower 111 may be distributed between valve 152 and torsion springs 159. Torsions springs 159 may be tuned relative to valve spring 153 such that torsion springs 159 yield in the non-engaging configuration while valve spring 153 does not. Inner arm 103B may descend as torsion springs 159 wind and outer arm 103A may remain in place. As a result, valve 152 may remain on its seat 156 even as cam 107 rotates. In the non-engaging configuration, camshaft 109 still does work on rocker arm assembly 106 as cam 107 rises off base circle. But in this case, most of the resulting energy is taken up by torsions springs 159, which act as lost motion springs.

Hydraulic lash adjuster 140 may be replaced by another type of lash adjuster or by a static pivot. Lash adjustment may be implemented using a hydraulic chamber 144 that is configured to vary in volume as hydraulic lash adjuster 140 extends or contracts through relative motion of inner sleeve 145 and outer sleeve 143. A supply port 146 in outer sleeve 143 may allow a reservoir chamber 142 to be filled from an oil gallery 128 in cylinder head 102. The fluid may be engine oil, which may be supplied at a pressure of about 2 atm. When cam 107 is on base circle, this pressure may be sufficient to open check valve 141, which admits oil into hydraulic chamber 144. The oil may fill hydraulic chamber 144, extending hydraulic lash adjuster 140 until there is no lash between cam 107 and roller follower 111. As cam 107 rises off base circle, hydraulic lash adjuster 140 may be compressed, pressure in hydraulic chamber 144 may rise, and check valve 141 may consequently close.

Shell 116 may be formed by a plurality of pieces of low coercivity ferromagnetic material, which may be described as pole pieces in that they are operative within electromagnetic latch assembly 122 to guide magnetic flux from the poles of permanent magnets 120 or coil 119. Rocker arm 103A may be formed of low coercivity ferromagnetic material and that may perform all or part of this same function. Shell 116 may wrap around the outside coil 119 and may also wrap partially inside to provide stepped edges 129. Low coercivity ferromagnetic portion 123 of latch pin 115 may be shaped to mate with stepped edges 129. During actuation, magnetic flux from coil 119 may follow a circuit that crosses an air gap between a stepped edge 129 and latch pin 115, in which case the stepped edge 129 may be operative to increase the magnetic forces through which latch pin 115 is actuated.

Electromagnetic latch assembly 122 may provide both extended and retracted positions in which latch pin 115 is stable. As a consequence, either the latched or unlatched configuration can be reliably maintained without coil 119 being powered. This may be advantageous when an electrical connection 108 is subject to interruption. Positional stability refers to the tendency of latch pin 115 to remain in and return to a particular position. Stability is provided by restorative forces that act against small perturbations of latch pin 115 from a stable position. Stabilizing forces may be provided by permanent magnets 120. Each of the extended and retracted positions may provide low reluctance pathways for magnetic flux from each of the permanent magnets 120. The reluctance of these pathways may be increased by small perturbations of latch pin 115 from a stable position. Alternatively, or in addition, one or more springs may be positioned to provide positional stability.

A conventional solenoid switch forms a magnetic circuit that includes an air gap, a spring that tends to enlarge the air gap, and an armature moveable to reduce the air gap. Moving the armature to reduce the air gap reduces the magnetic reluctance of that circuit. As a consequence, energizing a conventional solenoid switch causes the armature to move in the direction that reduces the air gap regardless of the direction of the current through the solenoid or the polarity of the resulting magnetic field. With electromagnetic latch assembly 122, however, latch pin 115 may be moved in either one direction or another depending on the polarity of the magnetic field generated by coil 119.

If coil 119 is energized with a direct current (DC) in a first direction, it may induce latch pin 115 to actuate from the extended position to the retracted position. The magnetic flux from coil 119 may reverse the magnetic polarity in low coercivity ferromagnetic elements such as shell 116, ring 121, and sleeve 123 that form low reluctance magnetic pathways through which permanent magnets 120 stabilize latch pin 115 in the extended position. That may greatly increase the reluctance of those magnetic circuits and cause magnetic flux from permanent magnets 120 to shift. The net magnetic forces on latch pin 115 may drive it to the retracted position.

While permanent magnets 120 may initially hold latch pin 115 in the extended position, at some point during latch pin 115's progress toward the retracted position, permanent magnets 120 begins to attract latch pin 115 toward the retracted position. At that point, the pathways for magnetic flux from permanent magnets 120 have shifted. Beyond that point, coil 119 may be disconnected from its power source and latch pin 115 may still complete its travel to the retracted position.

If coil 119 is energized with a current in a second direction, which is the reverse of the first direction, it may induce latch pin 115 to actuate from the retracted position to the extended position. The magnetic flux from coil 119 may reverse the magnetic polarity in low coercivity ferromagnetic elements forming magnetic circuits through which permanent magnets 120 stabilized latch pin 115 in the retracted position. That may greatly increase the reluctance of those magnetic circuits and cause magnetic flux from permanent magnets 120 to shift again. The net magnetic forces on latch pin 115 may drive it to the extended position. At some point during latch pin 115's progress toward the extended position, permanent magnets 120 begin to attract latch pin 115 toward the extended position. Accordingly, at some point during latch pin 115's progress, coil 119 may be disconnected from its power source and latch pin 115 may still complete its travel to the extended position.

As used herein, a permanent magnet is a high coercivity ferromagnetic material with residual magnetism. A high coercivity means that the polarities of permanent magnets 120 remain unchanged through hundreds of operations through which electromagnetic latch assembly 122 is operated to switch latch pin 115 between the extended and retracted positions. Examples of high coercivity ferromagnetic materials include compositions of AlNiCo and NdFeB.

Figure 8:
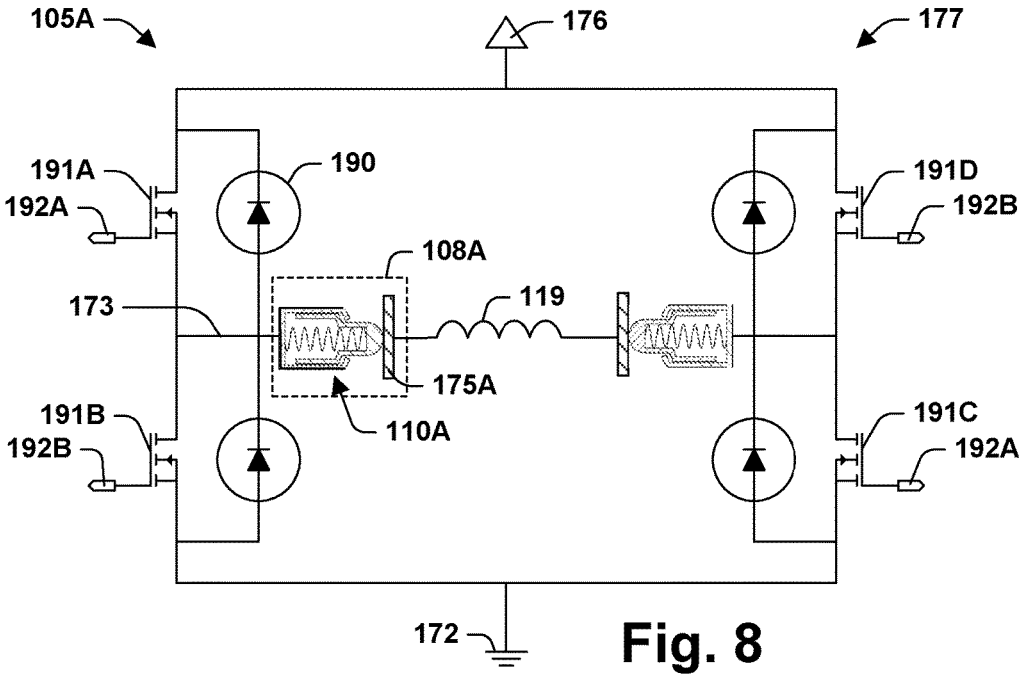
FIG. 8 is a schematic diagram of a circuit according to some aspects of the present teachings that may provide power to a rocker arm-mounted electrical device in the internal combustion engine of FIG. 1.

Coil 119 may be powered through an electrical circuit 105A that includes one or more electrical connections 108A formed by contact between pogo pins 110A and contact pads 175A. FIG. 8 provides a schematic diagram for an example electrical circuit 105A that also includes an H-bridge 177. H-bridge 177 may include diodes 190 and switches 191 that can be operated through signals 192 to selectively apply voltage from a power source 176 to coil 119 with current flowing in either a first or a second direction. One polarity may be used when it is desired to actuate latch pin 115 to the extended position and the other polarity may be used when it is desired to actuate latch pin 115 to the retracted position. The potential of ground 172 may be the potential of cylinder head 102. An alternative circuit 105A could be made operative to selectively couple coil 119 with one of two power sources, one source having a potential above ground 172 and the other below ground 172. In this alternative circuit structure, a single electrical connection 108A may be used to provide coil 119 with power for current in either direction while a connection to ground 172 may be formed through the structure of valvetrain 104A.

In some alternative embodiments, electromagnetic latch assembly 122 includes two coils 119 isolated from one-another, one with coils wound in a first direction and the other with coils wound in the opposite direction. Two circuits 105A with electrical connections 108 may then be used to power electromagnetic latch assembly 122. One of the circuits 105A may be closed to actuate latch pin 115 in a first direction and the other to actuate latch pin 115 in the reverse direction.

The portion of circuit 105A that includes electrical connection 108A is electrically isolated from ground 172 and cylinder head 102, which may be at the same potential. Electrical connection 108A may be made by surface contact between pogo pin 110A and contact pad 175A. Contact pad 175A may be mounted to but insulated from rocker arm 103A. Contact pad 175A may at times move in response to rotation of cam 107 by virtue of contact pad 175A being mounted to outer arm 103A. Accordingly, rocker arm assembly 106A is operative to cause the abutting surfaces of pogo pin connector 110A and contact pad 175A that form electrical connection 108A to shift and move relative to one another as cam 107 rotates. Different types of abutting structures could replace contact pad 175A and pogo pin connector 110A.

Figure 6:
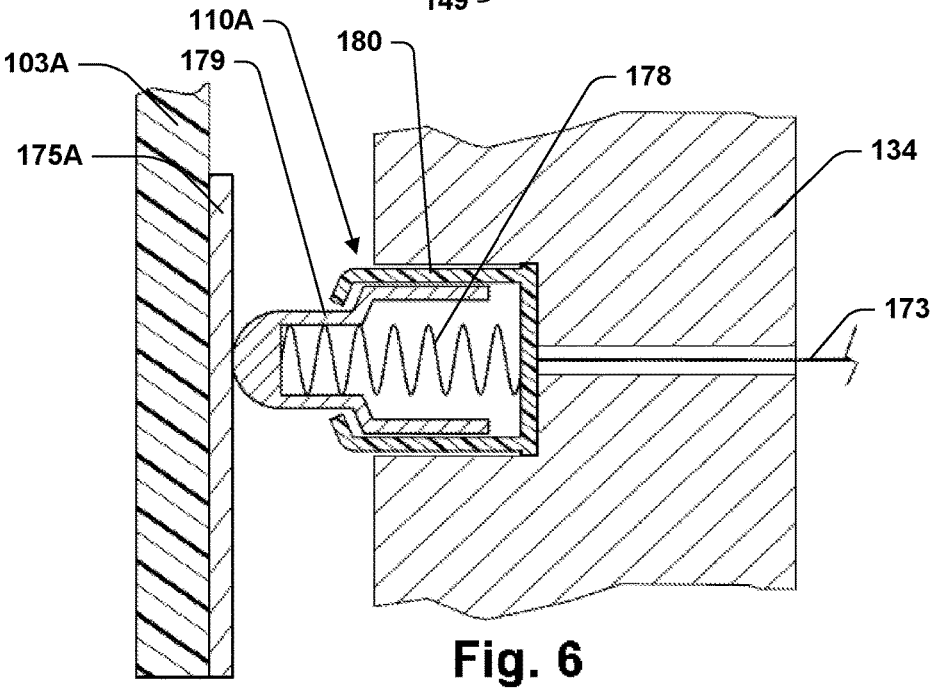
FIG. 6 is a cross-section along line 6-6 of FIG. 5 showing an electrical connection according to some aspects of the present teachings.
Figure 7:
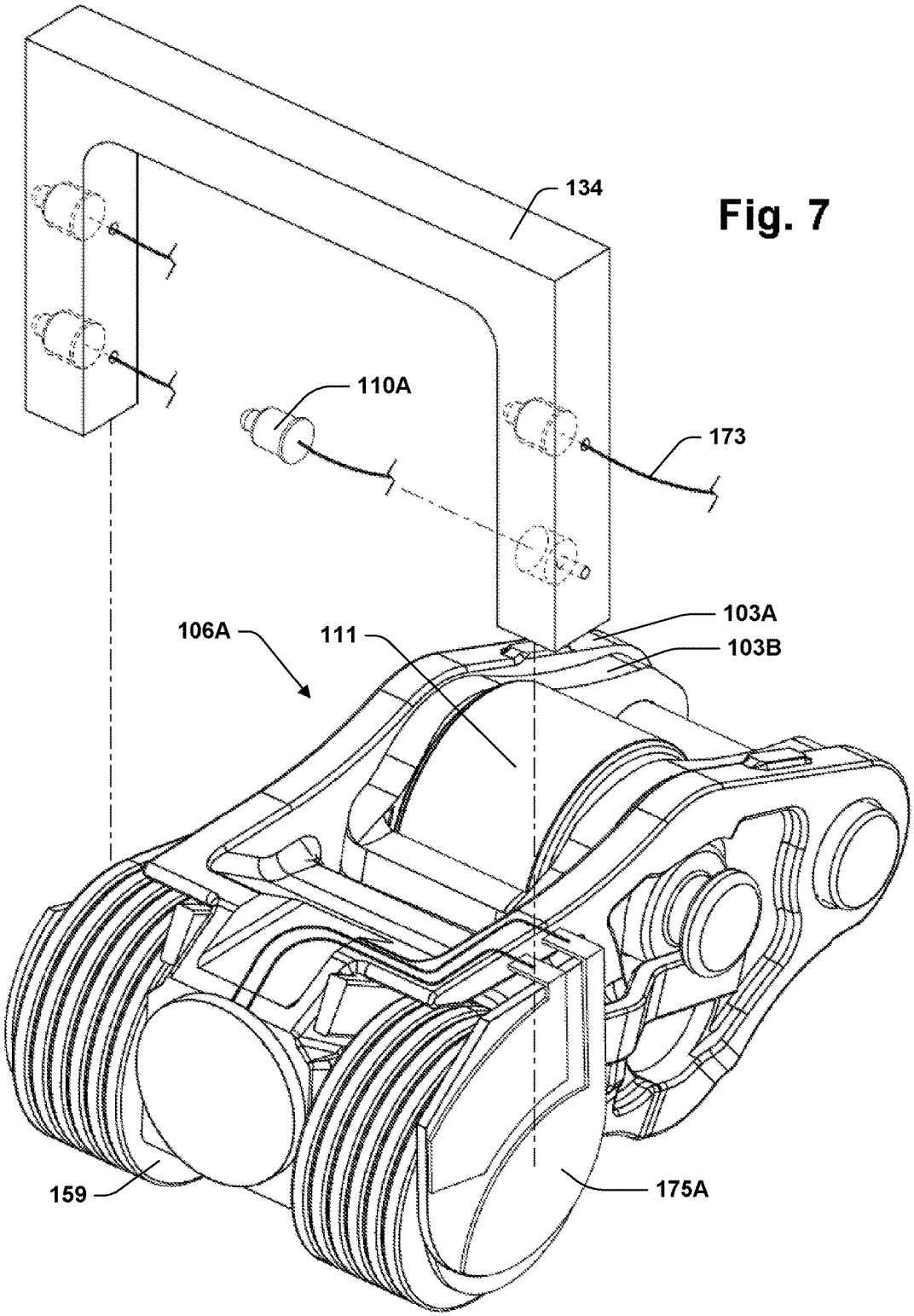
FIG. 7 is an exploded view of the parts shown in FIG. 5.

With reference to FIG. 6, pogo pin connector 110A may include a spring 178, an extending member 179, and a housing member 180. Spring 178 may be configured to bias extending member 179 outward from housing member 180 with the effect of providing a force that tends to lengthen pogo pin connector 110A and maintain extending member 179 in contact with an opposing surface such as a surface of contact pad 175A. Extending member 179 is conductive. Housing member 180 may be conductive. Spring 178 may also be conductive. Accordingly, current through extending member 179 may flow though spring 178, housing member 180, or both.

Rocker arm 103A is operative to pivot on HLA 140, which provides a fulcrum. The motion of rocker arm 103A is substantially constrained to a plane parallel to an axis on which rocker arm 103A pivots. Contact pad 175A may provide a relatively flat surface having a surface normal vector that is substantially parallel to that pivot axis. That geometry allows pogo pin connector 110A to remain substantially stationary while sliding over and continuously abutting contact pad 175A even as rocker arm 103A undergoes the pivoting movement. Pogo pin connector 110A may be fit with a roller and roll over contact pad 175A as rocker arm 103A pivots.

Figure 5:
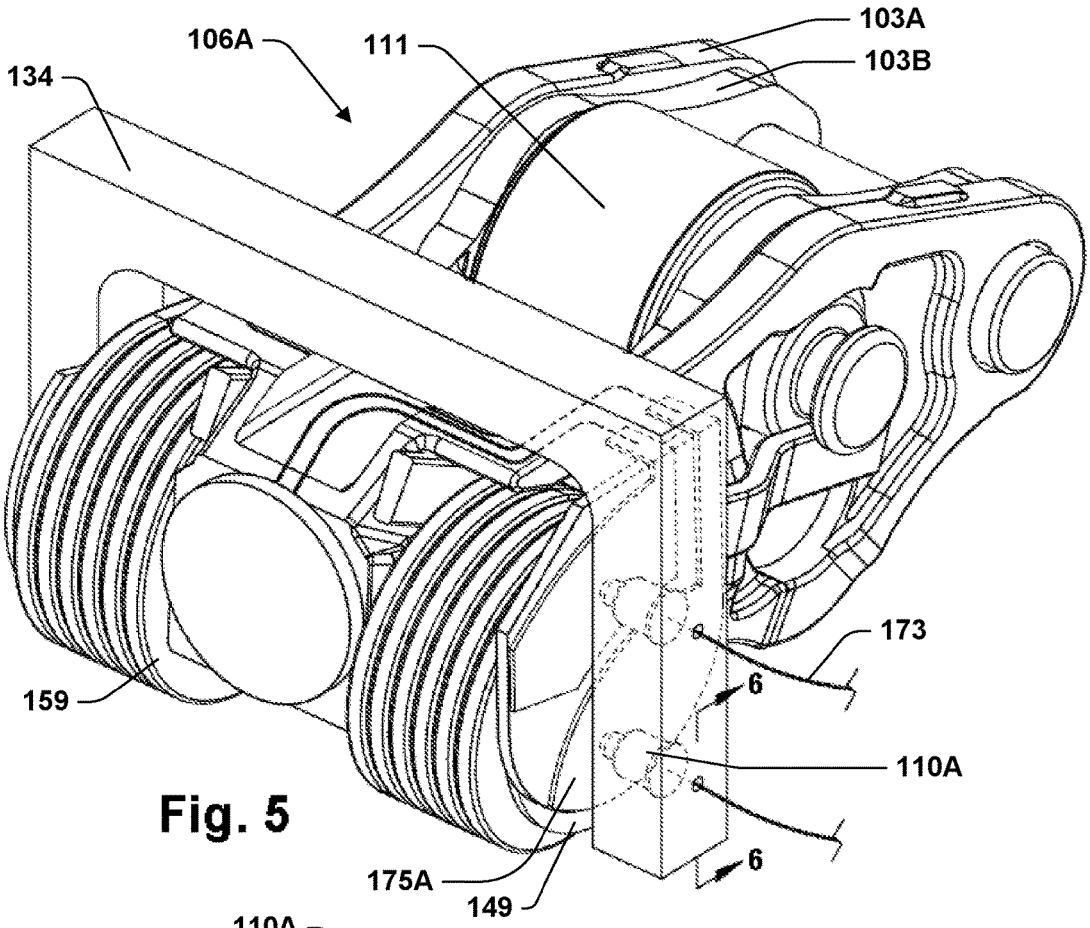
FIG. 5 is a perspective view of a rocker arm assembly of the internal combustion engine of FIG. 1 with electrical connections according to some aspects of the present teachings.

Contact pad 175A may be mounted over a spring post of rocker arm 103A. A spring post is a part of rocker arm 103A around which torsion spring 159 winds. With reference to FIG. 5, torsion springs 159 are mounted on hubs 149, which fit over the spring posts 157 (shown in the example of FIG. 23, but not in the example FIG. 5). Mounting frame 132A may hold pogo pin connector 110A in a substantially fixed position relative to cylinder head 102. Pogo pin connector 110A could be otherwise held in a substantially fixed position relative to cylinder head 102. Alternatively, pogo pin connector 110A could be mounted to outer arm 103A and contact pad 175A could be held to mounting frame 132A.

Figure 22:
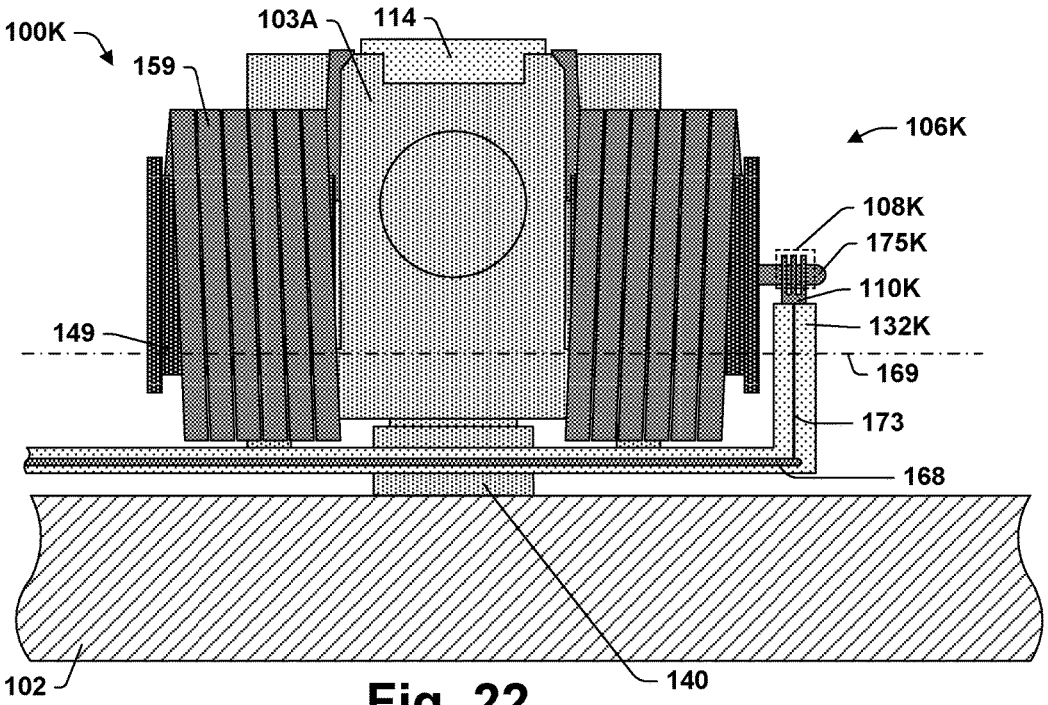
FIG. 22 is a rear view of a rocker arm assembly in a valvetrain according to some aspects of the present teachings.
Figure 23:
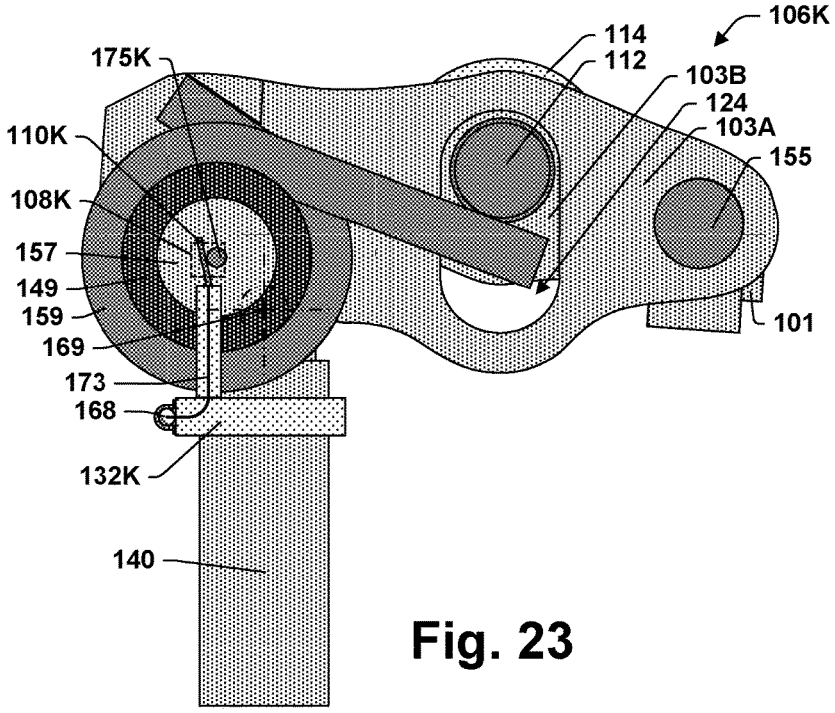
FIG. 23 is a side view of the rocker arm assembly in the valvetrain of FIG. 22.

FIGS. 22-23 illustrate an internal combustion engine 100K including a rocker arm assembly 106K that, like the rocker arm assembly 106A of engine 100A, has an electrical connection 108 formed by abutment between a part 110 mounted to a rocker arm 103 and a part 175 mounted to a part distinct from that rocker arm 103. In both these examples, the part 110 mounted to the rocker arm 103 may be mounted over, and optionally attached to, a spring post 157 of the rocker arm 103.

In engine 110K, an electrical connection 108K may be formed between contact pin 175K mounted to rocker arm 103A and motor brushes 110K mounted to a part distinct from rocker arm 103A. Motor brushes 110K may be held by a mounting frame 132K in a position where they are biased against and slide over contact pin 175K. Frame 132K is itself mounted to HLA 140. Frame 132K may extend to encompass a plurality of HLAs 140, which may facilitate holding mounting frame 132K in a fixed position. A wiring harness 168 may be held by frame 132K. Wiring harness 168 may include a plurality of wires 173 that connect to motor brushes 110K, whereby wiring harness 110K may carry power or communication signals for coil 119 or other electrical devices on a plurality of rocker arm assemblies 106K.

With reference to FIGS. 22 and 23, mounting a part 175 over a spring post 157 may place that part proximate a pivot axis 169 of rocker arm 103A. As a consequence of that proximity, the parts 110K and 175K that form electrical connection 108K undergo relatively little relative motion as rocker arm 103A moves through its range of motion. That may facilitate maintaining electrical connection 108K continuously.

While the top of HLA 140 may be approximately hemispherical or cylindrical and the mating surface of rocker arm 103A may have an approximately corresponding shape, either of these surfaces may deviate to some degree from any such idealized shape or perfect correspondence. As a result, the movement of rocker arm 103A may not be precisely restricted to a simple pivoting motion and the location of pivot axis 169 may not be exactly and uniquely determined. These types of variations from the ideal that are common in rocker arm assemblies and the resulting uncertainties in location of pivot axis 169 are negligible for purposes of the present disclosure.

Figure 9:
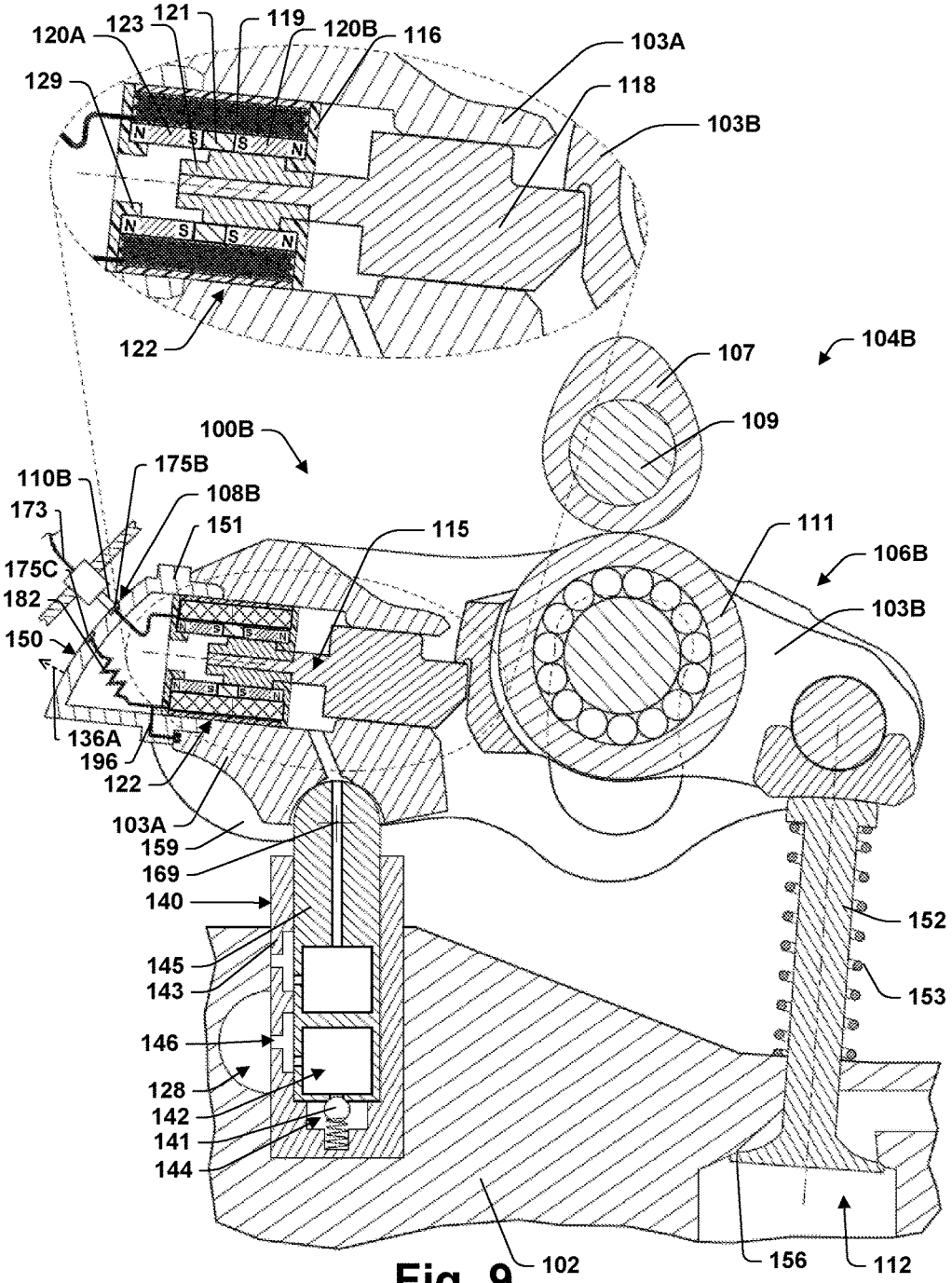
FIG. 9 is a cross-sectional view of a portion of an internal combustion engine including a valvetrain according to some aspects of the present teachings.
Figure 10:
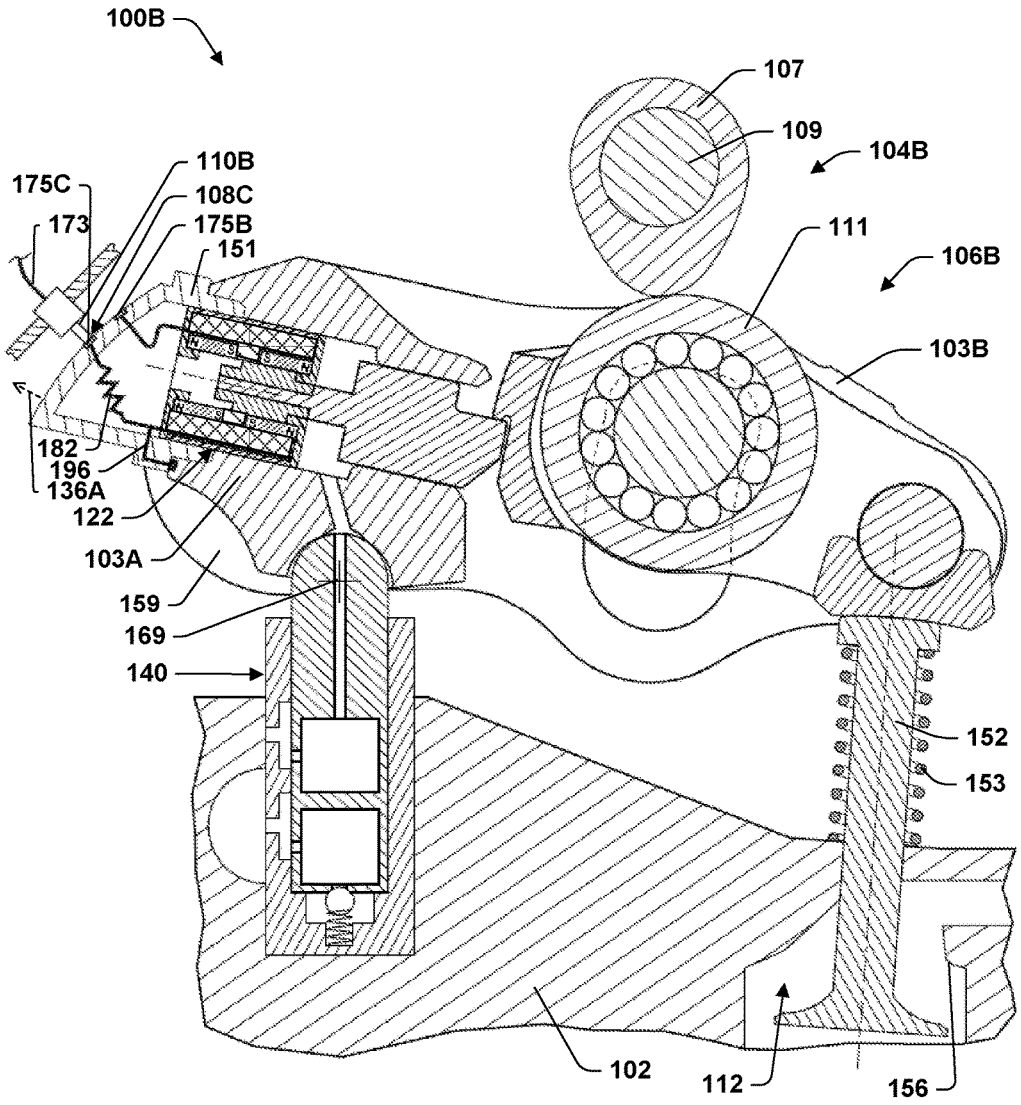
FIG. 10 is a cross-sectional view of a portion of the internal combustion engine of FIG. 9 with a rocker arm assembly in a latched stated and a cam off base circle.
Figure 11:
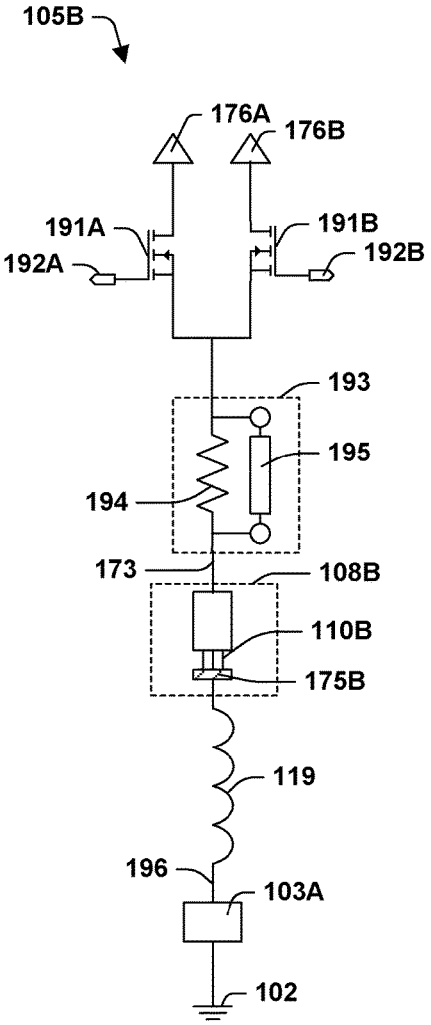
FIG. 11 is a schematic diagram of a circuit according to some aspects of the present teachings that may provide power to a rocker arm-mounted electrical device in the internal combustion engine of FIGS. 9 and 10.

FIGS. 9-10 illustrate an internal combustion engine 100B that includes a valvetrain 104B having a rocker arm assembly 106B. Coil 119 of rocker arm assembly 106B may be powered through an electrical circuit 105B for which FIG. 11 provides an example. Electrical circuit 105B may include an electrical connection 108B formed between brushes 110B and contact pad 175B. Contact pad 175B may be mounted to rocker arm 103A.

Electrical circuit 105B may include power sources 176A and 176B. One of these sources may provide a voltage above the potential of cylinder head 102 while the other provides a voltage below the potential of cylinder head 102. Cylinder head 102 may be operative as a ground. Switches 191A and 191B may be operated through control signals 192A and 192B to selectively couple one or the other of sources 176A and 176B to a first pole of coil 119. Wire 196 may connect a second pole of coil 119 to rocker arm 103A, which may be electrically coupled to cylinder head 102 through the structure of valvetrain 104B including outer arm 103A and HLA 140. Alternatively, rocker arm assembly 106B may be provided with two electrical connections 108B and coil 119 may be powered through a circuit like electrical circuit 105A.

Valvetrain 104B may be operative to move rocker arm 103A through a range of motion. That range of motion may include a first portion over which connection 108B is closed and a second portion over which electrical connection 108B is open. Within at least the portion of the range of motion over which connection 108B is closed, the motion of rocker arm 103B may move contact pads 175B in a direction that is substantially perpendicular to the orientation of brushes 110B. Brushes 110B may therefore bend and slide over the surfaces of contact pads 175B. Brushes 110B may be of a type used in motors.

Surfaces adjacent the conducting surface of contact pad 175B may be insulated so that electrical circuit 105B is opened and closed as electrical connection 108B is opened and closed. Electrical circuit 105B may be monitored to detect the forming and breaking of electrical connection 108B. This information may be used to monitor the motion of rocker arm 103A. That information may be useful in making diagnostic determinations, which may be reported. Alternatively, that information may be used for engine management.

A current measuring device 193 may be provided to detect the forming and breaking of electrical connection 108B. As illustrated in FIG. 11, current measuring device 193 may include a shunt resistor 194 configured within electrical circuit 105B and a voltage measuring device 195 connected across shunt resistor 194. Another alternative for current measuring device 193 is an inductive coil configured to measure current in circuit 105B.

Figure 12:
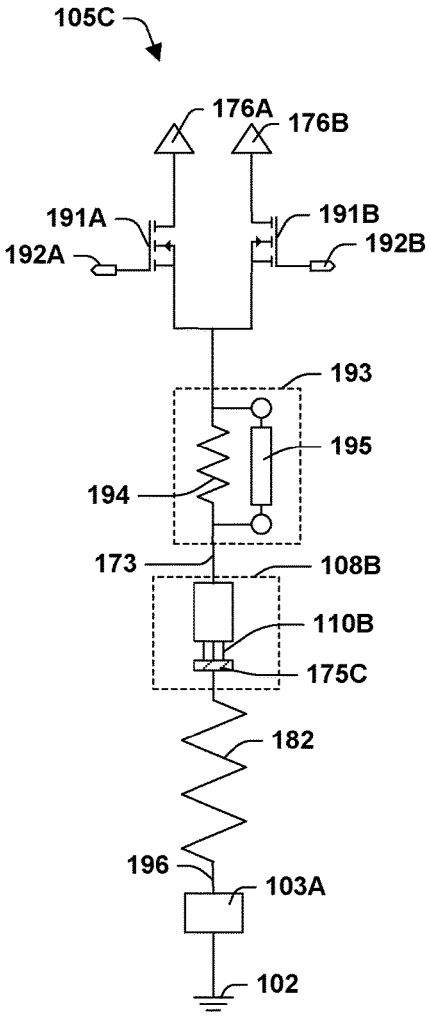
FIG. 12 is a schematic diagram of a circuit according to some aspects of the present teachings that may provide diagnostic information for a rocker arm assembly of the internal combustion engine of FIGS. 9 and 10.

In some aspects of the present teachings, a second contact pad 175C is also mounted to rocker arm 103A. As shown in FIG. 10, over a portion of rocker arm 103A's range of motion, brushes 110B may make brush against contact pad 175C to form an electrical connection 108C, completing a circuit 105C for which FIG. 12 provides an example. The portion of rocker arm 103A's range of motion over which brushes 110B abut second contact pad 175C to form electrical connection 108C may be disjoint from that portion over which brushes 110B make contact with contact pad 175B to form electrical connection 108B. A resistor 182 may be positioned to connect between second contact pad 175C and a ground, such as cylinder head 102. Resistor 182 may be selected to be the principal source of resistance in circuit 105C.

A voltage may be applied to circuit 105C at a time when actuation of latch pin 115 is not desired. The voltage may be from source 176A, source 176B, or some other source. In some of these teaching, that voltage is selected to be of the wrong polarity to induce motion of latch pin 115 from its current position. In some of these teaching, that voltage is less than a voltage required to actuate latch pin 115. Given the resistance of circuit 105C and the magnitude of the applied voltage, a current of predictable magnitude may flow through circuit 105C but only at such times that electrical connection 108C is closed. The presence or absence of that current may be detected by current measuring device 193 and that detection used to monitor the motion of rocker arm 103A and make diagnostic determinations on the basis thereof.

Contact pads 175B and 175C are mounted to rocker arm 103A on a projecting structure 151. Projecting structure 151 supports contacts pads 175B and 175C on a surface 150 that has a normal vector 136 that points approximately directly away from the approximate axis 169 about which rocker arm 103A pivots. "Points approximately directly away" means that a line through normal vector 136 would come close to intersecting axis 169. The radius of curvature of surface 150 is approximately equal to its distance from pivot axis 169. As a result of these two conditions, the distance from the base of motor brushes 110B and surface 150 remains nearly constant as rocker arm 103A pivots through it range of motion. This structure facilitates motor brushes 110B making contact first with contact pad 175B and then with contact pad 175C as rocker arm 103A pivots through it range of motion. If contact pad 175B were extended along surface 150, this same structure could be used to maintain contact between motor brushes 110B and contact pad 175B throughout the range of motion of rocker arm 103A.

Figure 24:
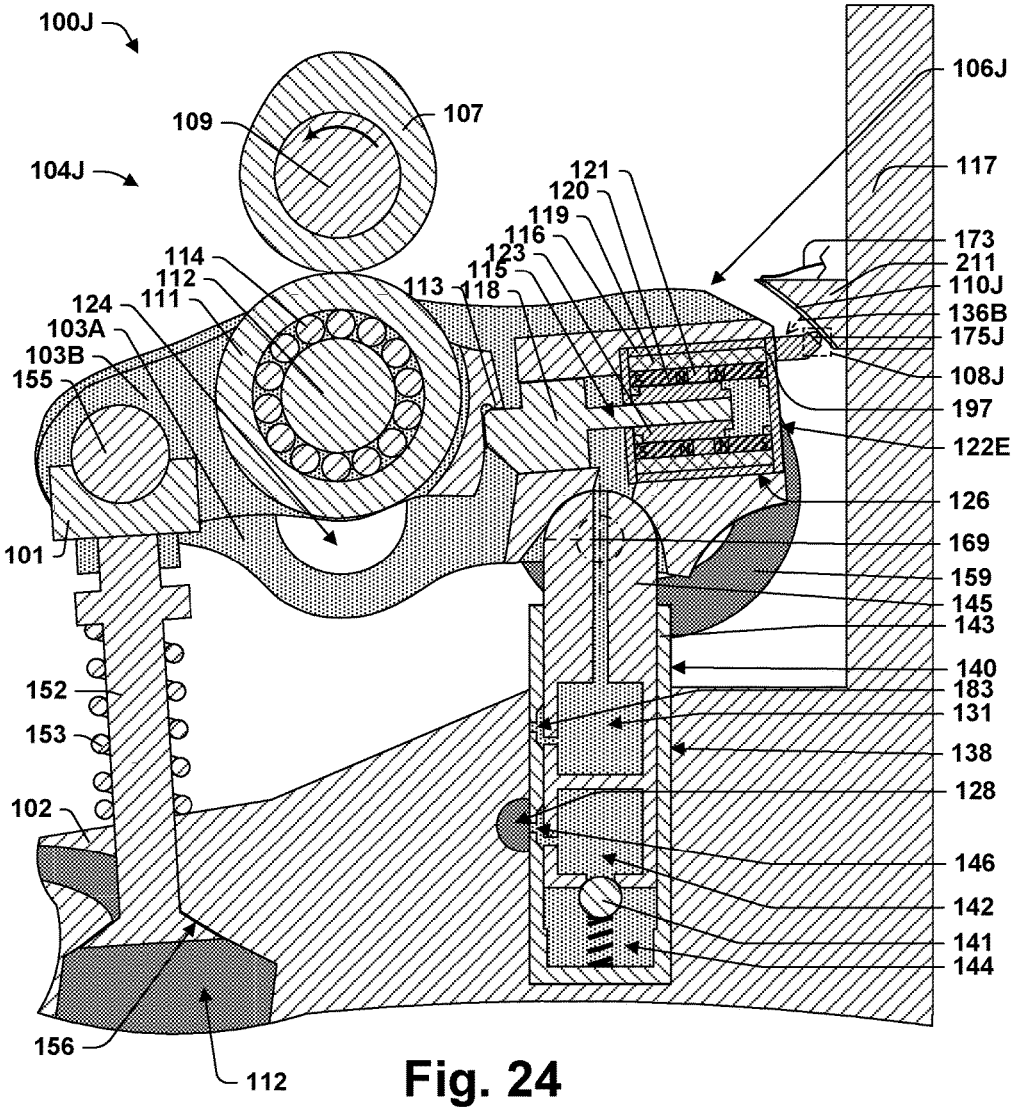
FIG. 24 is a cross-sectional view of a portion of an internal combustion engine including a valvetrain according to some aspects of the present teachings.

FIG. 24 illustrates an internal combustion 100J that uses a similar structure to maintain a connection 108J between a roller 175J mounted to rocker arm assembly 106J and a contact pad 110J. Contact pad 110J may be held by frame 211 to a cam carrier 117. Contact pad 110J has a surface with a radius of curvature approximately equal to its distance from pivot axis 169 and a surface normal vector 136B oriented approximately in the direction of pivot axis 169. This direction need not be the shortest distance to pivot axis 169, but may approximately intersect pivot axis 169 with some angle of incidence. This structure allows roller 175J to remain in abutment with contact pad 110J even as rocker arm 103A moves through its range of motion. Roller 175J may be biased against contact pad 110J by a spring (not shown) to maintain contact while allowing some upward and downward motion of rocker arm 103A for lash adjustment.

Figure 13:
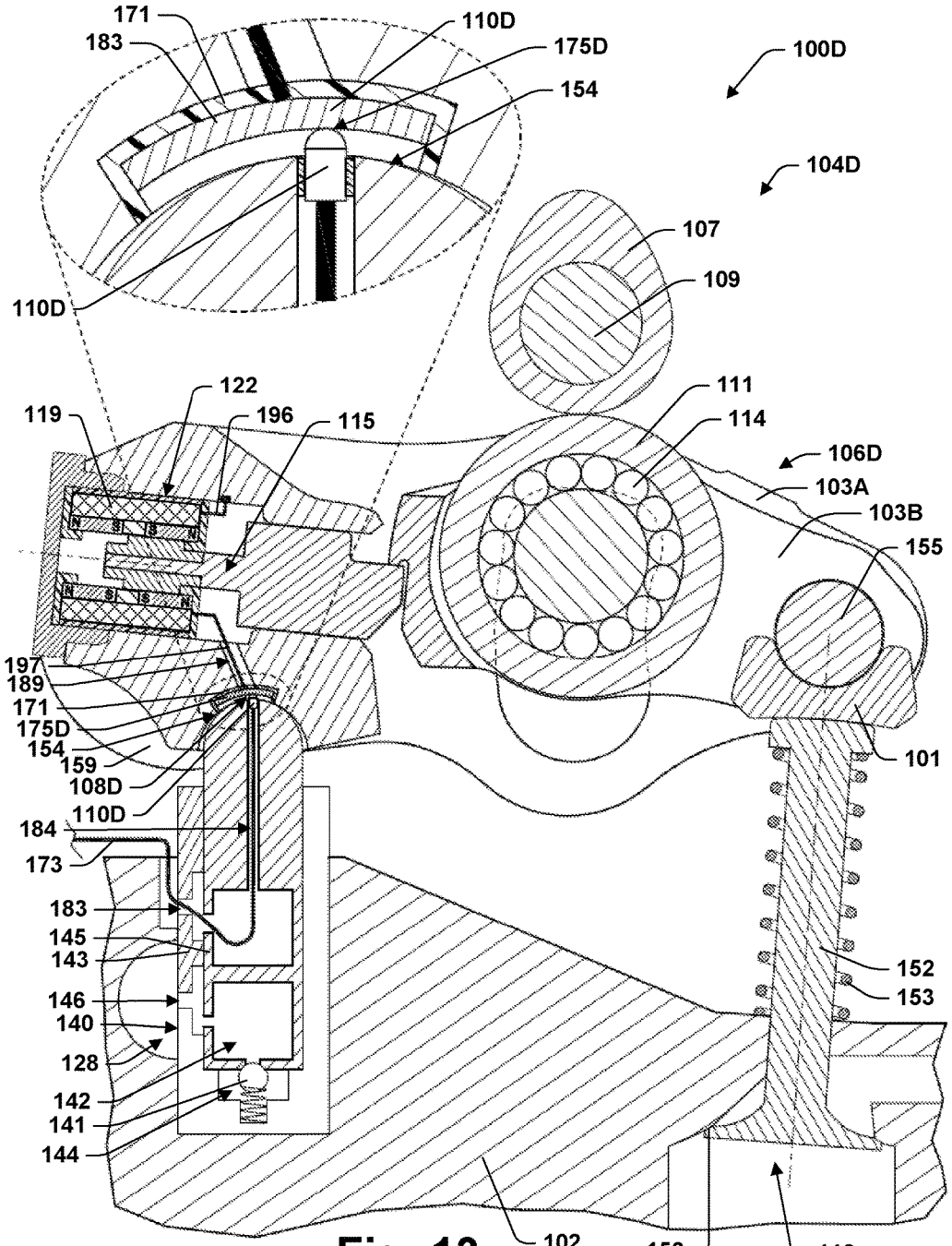
FIG. 13 is a cross-sectional view of a portion of an internal combustion engine including a valvetrain according to some aspects of the present teachings.
Figure 14:
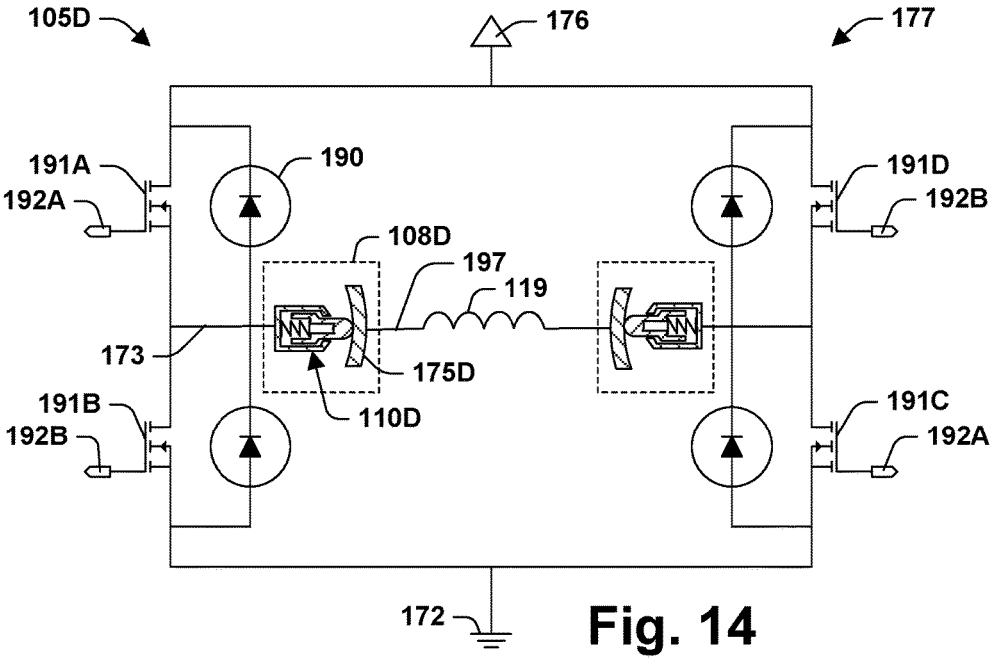
FIG. 14 is a schematic diagram of a circuit according to some aspects of the present teachings that may provide power to a rocker arm-mounted electrical device in the internal combustion engine of FIG. 13.

FIG. 13 illustrates an internal combustion engine 100D that includes a valvetrain 104D having a rocker arm assembly 106D. Rocker arm assembly 106D includes a rocker arm 103A on which may be mounted an electromagnetic latch assembly 122 that includes coil 119. Coil 119 may be powered through an electrical connection 108D that may be formed within an interface region 154 where rocker arm 103A contacts and pivots on HLA 140. A pair of electrical connections 108D may be provided side-by-side at this location to form an electrical circuit 105D as illustrated in FIG. 14. Rocker arm 103A and HLA 140 are (mechanical) load-bearing members of valvetrain 104D. Other examples of load-bearing members of valvetrain 104D include elephant's foot 101, roller follower 111, roller bearings 114 and their bearing races, latch pin 115, poppet valve 152, axle 155, and torsion springs 159.

Electrical connections 108D may be formed by surface contact between first parts 110D mounted to HLA 140 and second parts 175D mounted to rocker arm 103A. Parts 110D may be insulated from surrounding areas of HLA 140. An insulating layer 171 may insulate part 175D from surrounding areas of rocker arm 103A. One or both of parts 110D and 175D may be sprung to bias them into contact. In one example, parts 175D are spring clips. In another example, parts 110D are pogo pin connectors. Both parts 175D and 110D may include sprung members biasing them into contact. Insulating layer 171 may be formed from any suitable material.

Engine 100D has wires 173 that form part of electrical circuit 105D entering HLA 140 through a port 183 and running upward to rocker arm 103A through a passage 184 within HLA 140. Wires 197, which form another part of circuit 105D, run through a hydraulic passage 189 in rocker arm 103A. Port 183 may be a port designed to admit hydraulic fluid from cylinder head 102 into HLA 140. The chamber within rocker arm 103A that houses electromagnetic latch assembly 122 may have been designed as a hydraulic chamber for a hydraulic latch. The interface 154 between HLA 140 and rocker arm 103A may have been designed to form a seal and allow the transfer of hydraulic fluid from passage 184 to passage 189. Running wires in these locations can be useful even if sliding electrical connection 108D is replaced by a fixed connection or a continuous run of wire.

Figure 25:
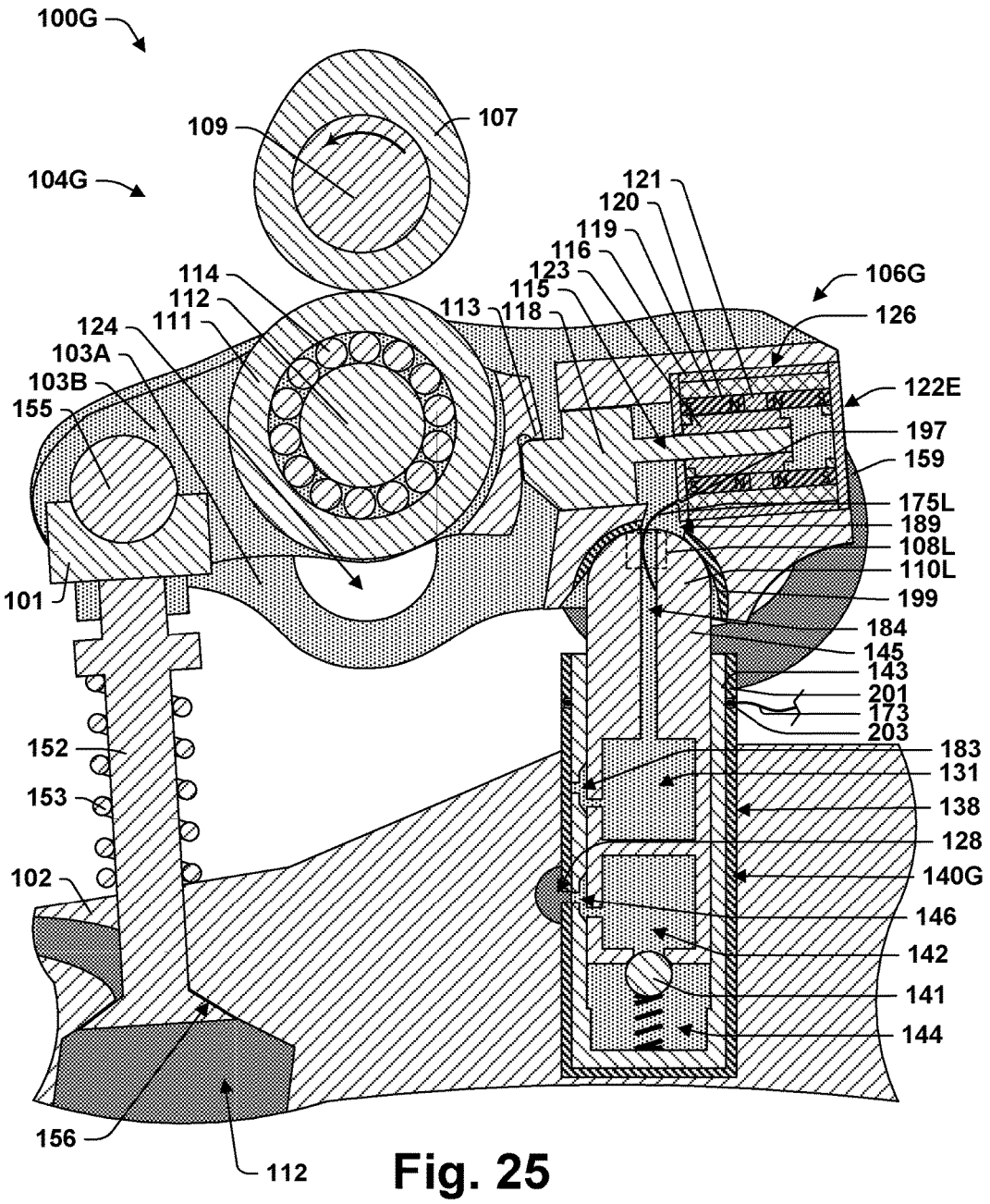
FIG. 25 is a cross-sectional view of a portion of an internal combustion engine including a valvetrain according to some aspects of the present teachings.
Figure 26:
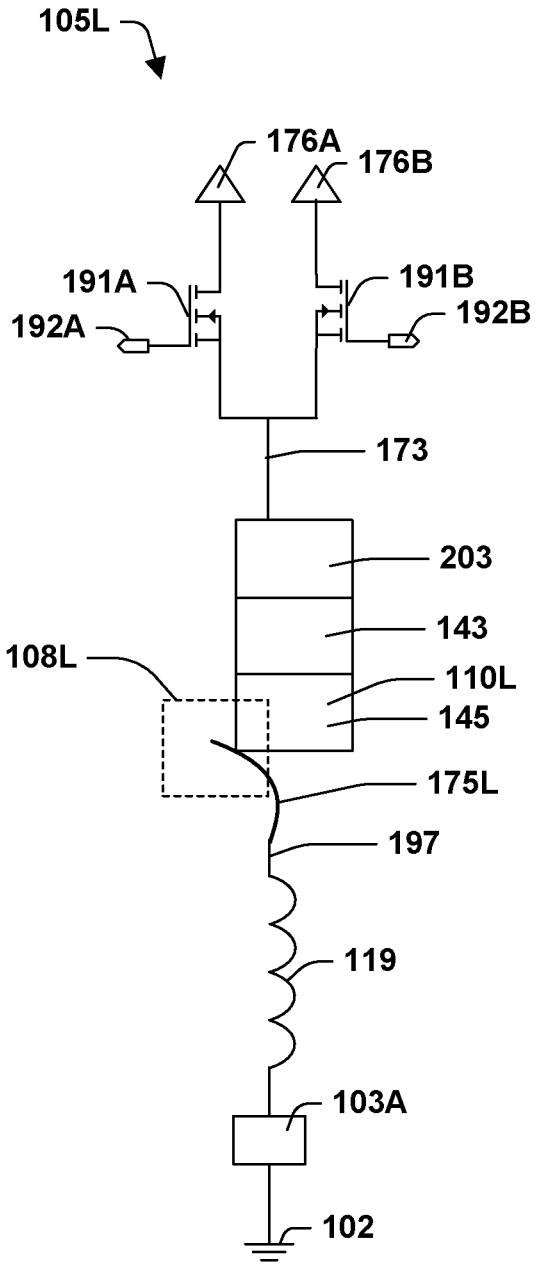
FIG. 26 is a schematic diagram of a circuit according to some aspects of the present teachings that may provide power to a rocker arm-mounted electrical device in the internal combustion engine of FIG. 25.

Engine 100D is an example in which an electrical connection 108 is formed by abutment between a first part 110 mounted to or forming part of a hydraulic lash adjuster 140 and another part 175 mounted to of forming part of a rocker arm 103. Engine 100G of FIG. 25 provides another example. Engine 100G is also an example in which a rocker arm assembly 106G includes a hydraulic lash adjuster 140G that may be electrically isolated from cylinder head 102 and form part of a circuit 105L through which an electrical device, such as solenoid 122, mounted to a rocker arm 103A may be powered. FIG. 26 provides a diagram for an example circuit 105L.

Hydraulic lash adjuster 140G may be insulated from cylinder heard 102 by an insulating sleeve 201. Alternatively, a non-conductive coating may be used in place of sleeve 201. Hydraulic lash adjuster 140G may be insulated from rocker arm 103A by insulating cup 199. Insulating cup 199 may be load-bearing and constructed of any suitable material. A suitable material may be, for example, a ceramic such as SiC or a polymer such as an epoxy. Insulating cup 199 may be replaced by a similar structure formed into HLA 140G. An electrically insulating coating may be used in place of either of these structures.

Inner sleeve 145 and or outer sleeve 143 of HLA 140G may be left free to rotate within the bore 138 in cylinder head 102 to reduce wear at the interface with rocker arm 103A. On the other hand, it may be desirable to restrict rotation of insulating sleeve 201 so that it may provide a stationary support for a wire 173. A conductive ring 203 may be used to form an electrical connection between wire 173 and outer sleeve 143 while permitting relative rotation between outer sleeve 143 and insulating sleeve 201. Besides electrical connection 108L, circuit 105L includes sliding contact between conductive ring 203 and outer sleeve 143 and sliding contact between outer sleeve 143 and inner sleeve 145

A leaf spring 175L formed of one or more ribbons of metal may be mounted to outer arm 103A and form electrical connection 108L by sliding contact with inner sleeve 145, also referred to as part 110L in this example. Brushes or another type of structure could be used in place of leaf spring 175L to make contact between the portion of circuit 105L that is mounted to rocker arm 103A and the portion of circuit 105L that is mounted to or part of HLA 140G. In some of these teachings, the contact is made with the top of inner sleeve 145. Such a contact could be placed underneath the insulating cup 199. Alternatively, rocker arm 103A could be electrically isolated from cylinder head 102 and electrical connection 108L could be made by direct contact between HLA 140G and rocker arm 103A. Another connection 108 formed by abutment could be used for a ground connection.

Mounting wires 173 to HLA 140 may provide several advantages. One advantage is that HLA 140 may provide a relatively stationary location to mount wires, particularly an HLA 140G fit with a sleeve 201 that is prevented from rotating. Another advantage is that HLA 140 provides a location to mount a part 110 in which it has a well-controlled spatial relationship to another part 175 that may be mounted to a rocker arm 103. The parts 110 and 175 may then be configured to abut and form electrical connection 108. Engine 100M of FIG. 27 and engine 100N of FIG. 28 provide additional examples demonstrating this concept.

Figure 27:
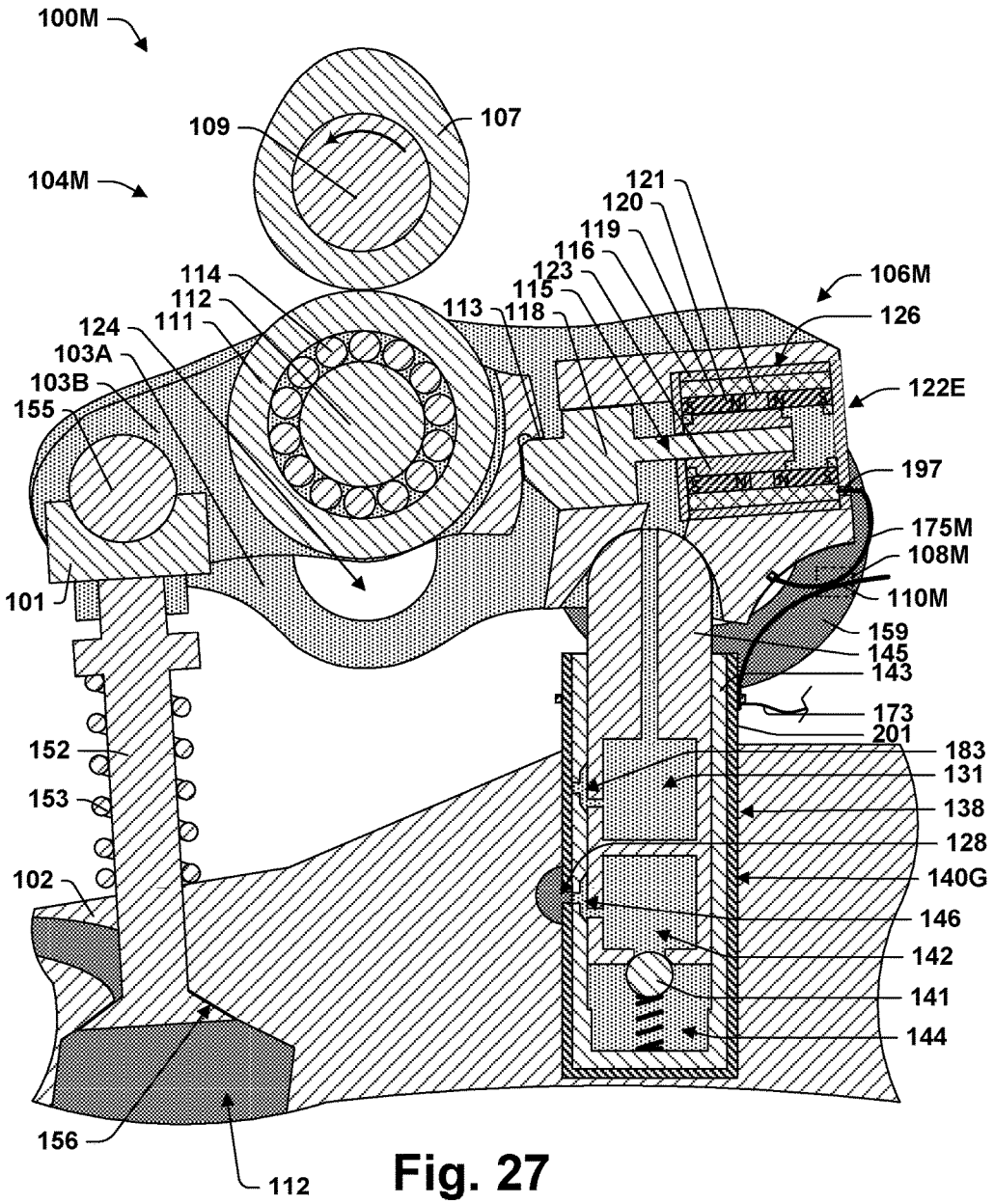
FIG. 27 is a cross-sectional view of a portion of an internal combustion engine including a valvetrain according to some aspects of the present teachings.

With reference to FIG. 27, an electrical connection 108M is formed by abutment between part 110M mounted to HLA 140G and part 175M mounted to rocker arm 103A. Part 110M is a spring, brush or other structure with sufficient resilience to bend when deformed by movement of rocker arm 103A but spring back to maintain contact with part 175M when the movement is reversed.

Figure 28:
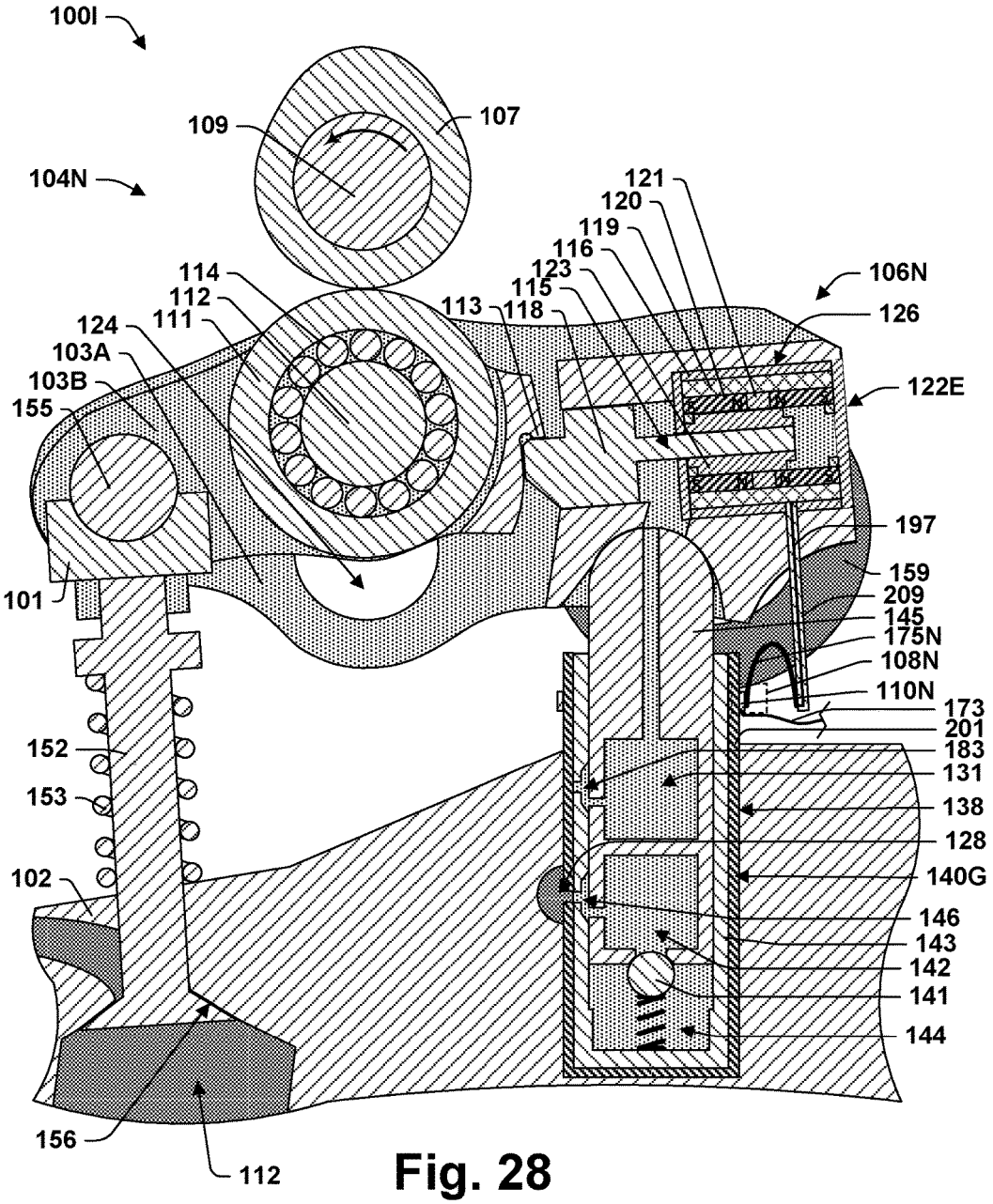
FIG. 28 is a cross-sectional view of a portion of an internal combustion engine including a valvetrain according to some aspects of the present teachings.

With reference to FIG. 28, a spring, brush or other structure 175N that is mounted to rocker arm 103A is biased against a conductive ring 110N mounted to the outside of insulating sleeve 201 in order to form the connection 110N. A rod 209 or other structure may extend from rocker arm 103A to support structure 175N in proximity to HLA 140G. Structure 175N may have sufficient resilience to maintain electrical connection 110N throughout the motion of rocker arm 103A.

Figure 15:
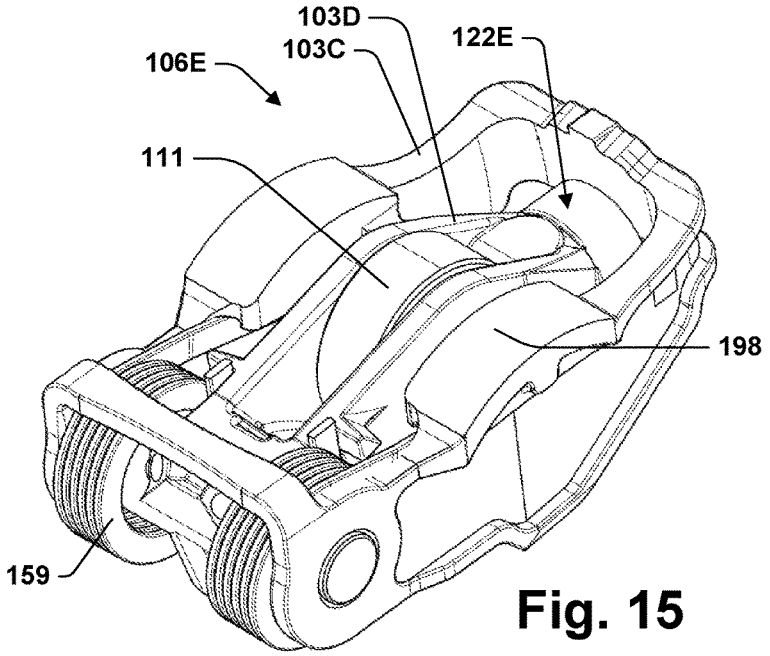
FIG. 15 is a perspective view of a rocker arm assembly of the internal combustion engine of FIGS. 16 and 17.
Figure 16:
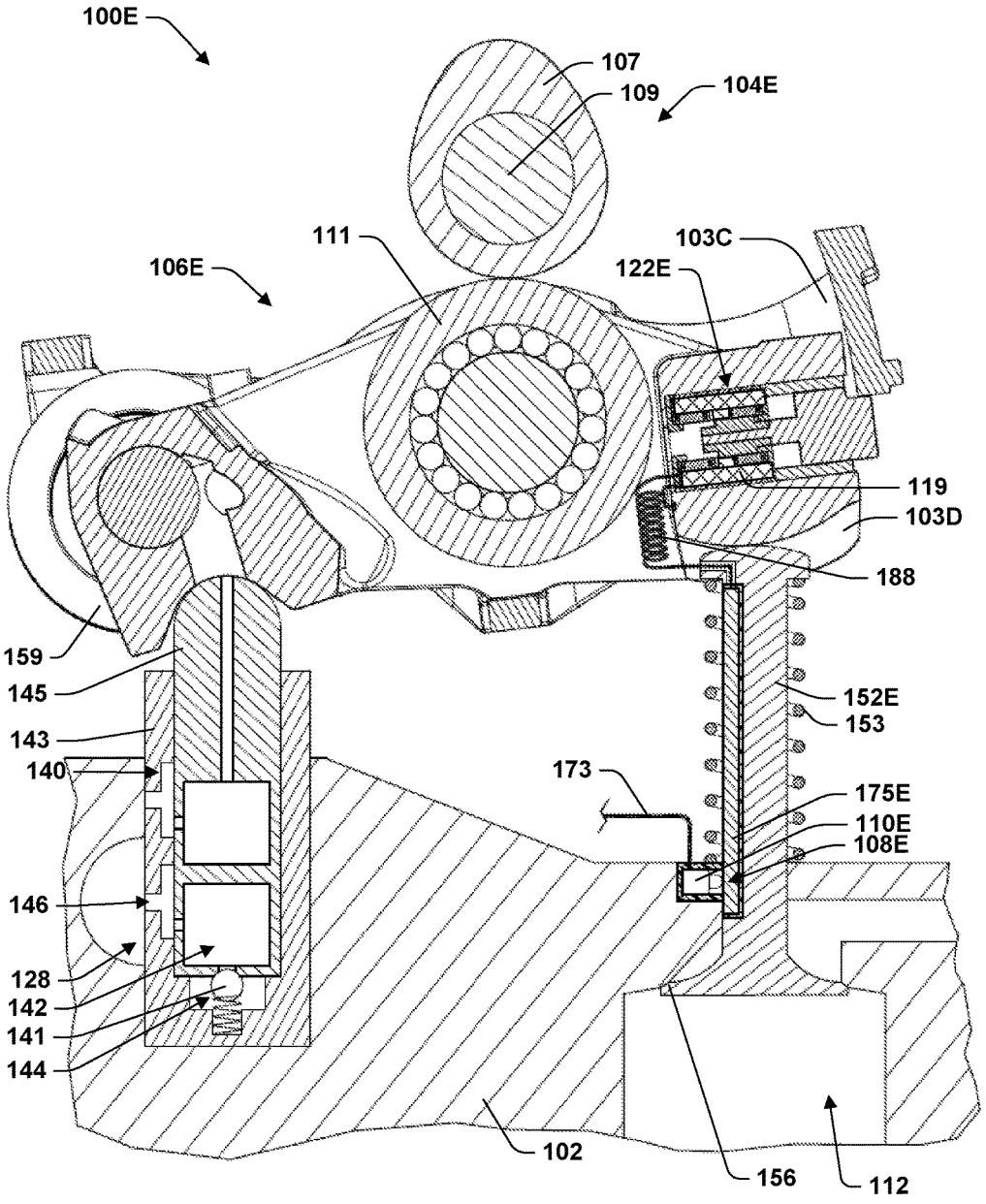
FIG. 16 is a cross-sectional view of a portion of an internal combustion engine including a valvetrain according to some aspects of the present teachings.
Figure 17:
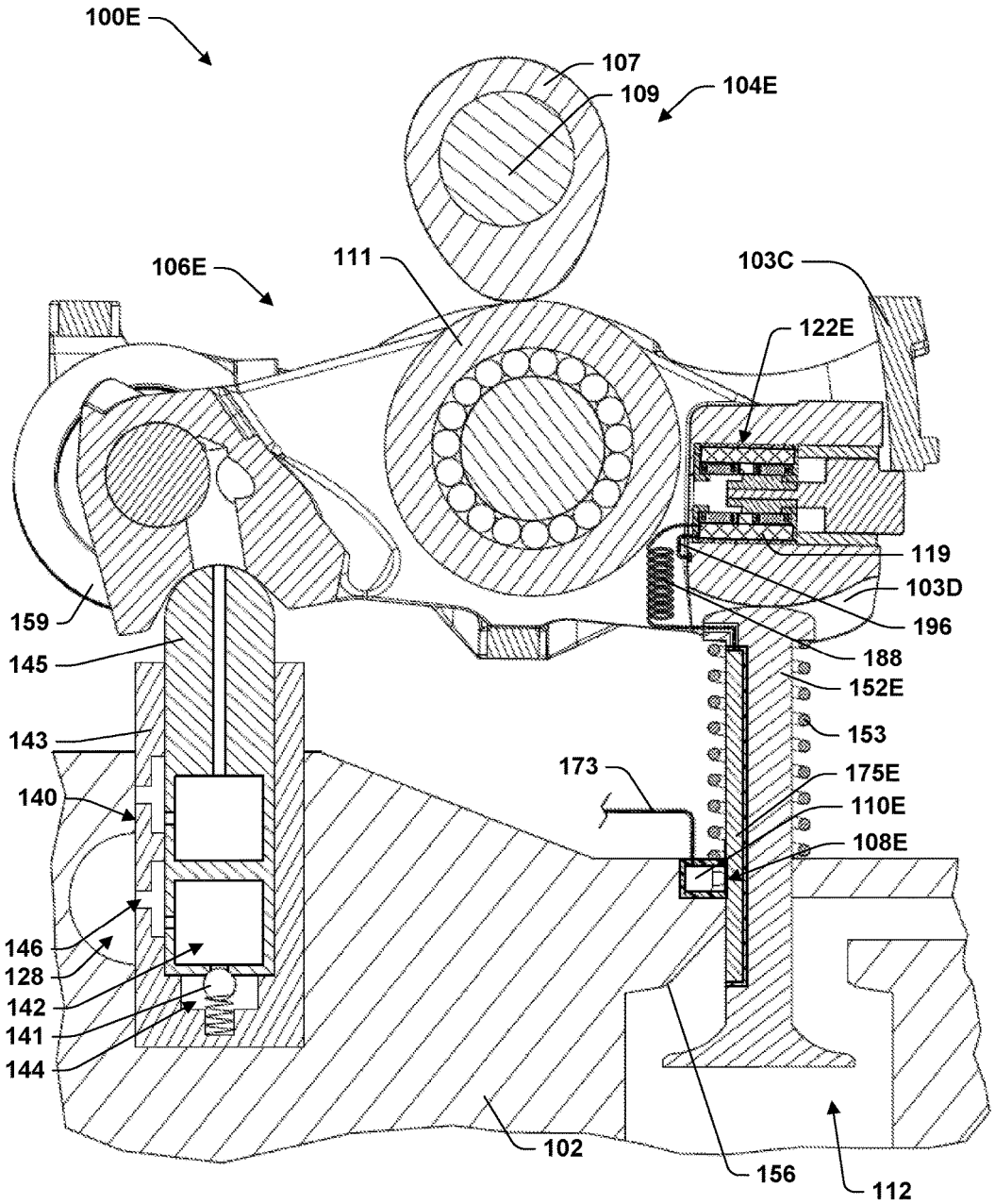
FIG. 17 is a cross-sectional view of a portion of the internal combustion engine of FIG. 16 with a rocker arm assembly in a latched stated and a cam off base circle.

FIGS. 16-17 illustrate an internal combustion engine 100E that includes a valvetrain 104E having a rocker arm assembly 106E. FIG. 15 provides a prospective view of rocker arm assembly 106E. Rocker arm assembly 106E may be a switching rocker arm including an inner arm 103D and an outer arm 103C. A cam follower 111 mounted to inner arm 103C may be configured to engage cam 107. Cam followers 198, which may be sliders, may be configured to engage additional cams (not shown) to provide an alternate valve lift profile from the one provided by cam 107. An electromagnetic latch assembly 122 having a coil 119 may be mounted to inner arm 103D.

Figure 18:
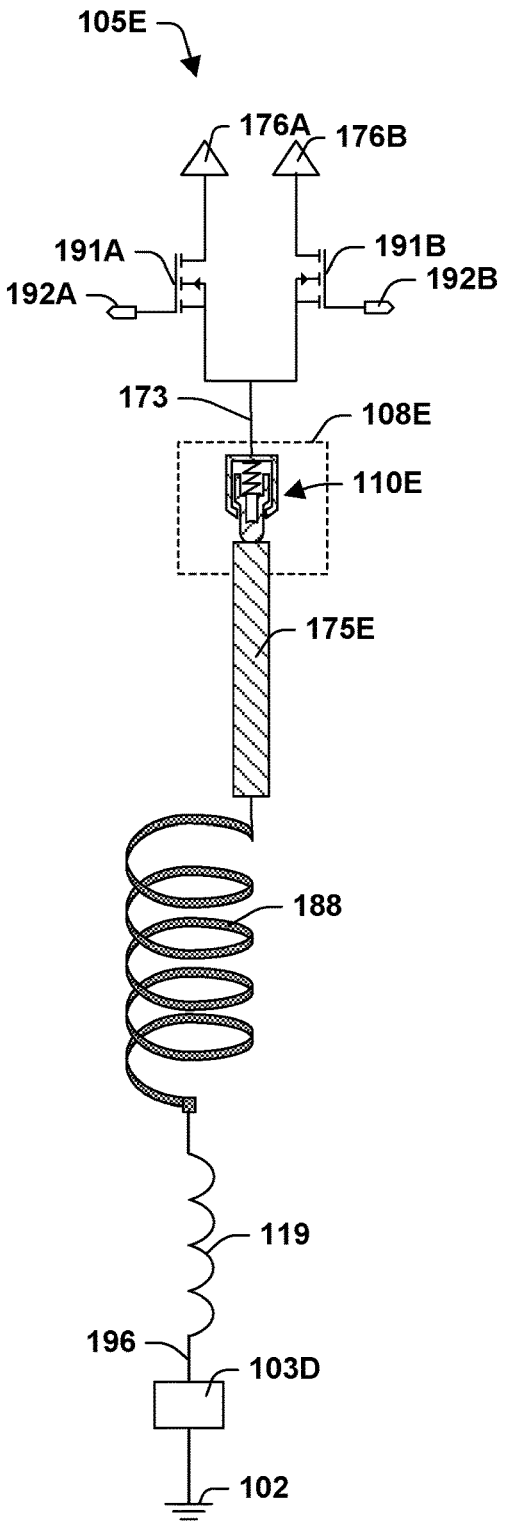
FIG. 18 is a schematic diagram of a circuit according to some aspects of the present teachings that may provide power to a rocker arm-mounted electrical device in the internal combustion engine of FIGS. 16 and 17.

Referring to FIGS. 16-18, coil 119 may be powered through an electrical circuit 105E that includes an electrical connection 108E that is formed between a conductive inlay 175E in valve 152 and pogo pin 110E mounted to cylinder head 102. Valve 152 is a load-bearing member of valvetrain 104E. Valve 152 transmits force between rocker arm 103D and valve spring 153.

FIG. 18 provides a schematic diagram for an example electrical circuit 105E. A part of electrical circuit 105E may be formed by a ribbon or coil of metal 188 making a connection between conductive inlay 187 and coil 119 mounted to inner arm 103D. Ribbon or coil of metal 188 may be relatively stiff. Coil 119 may be grounded to inner arm 103D.

As shown in FIGS. 16 and 17, as valve 152 opens and closes, pogo pin 110E may slide up and down valve 152 while remaining in contact with conductive inlay 175E and keeping electrical connection 108E closed. Pogo pin 110E may be replaced by another type of part suitable for sliding along conductive inlay 175E while maintaining an electrical connection. Alternatives include, without limitation, motor brushes and spring clips. An alternative to conductive inlay 175E is a conductive trace on the surface of valve 152. Another alternative is to insulate valve 152 where it makes contact with other metal parts, whereby the body of valve 152 may be part of electrical circuit 105E. In each of these examples, a portion of electrical circuit 108E is rigidly coupled to and disposed along the length of the stem of valve 152.

Figure 19:
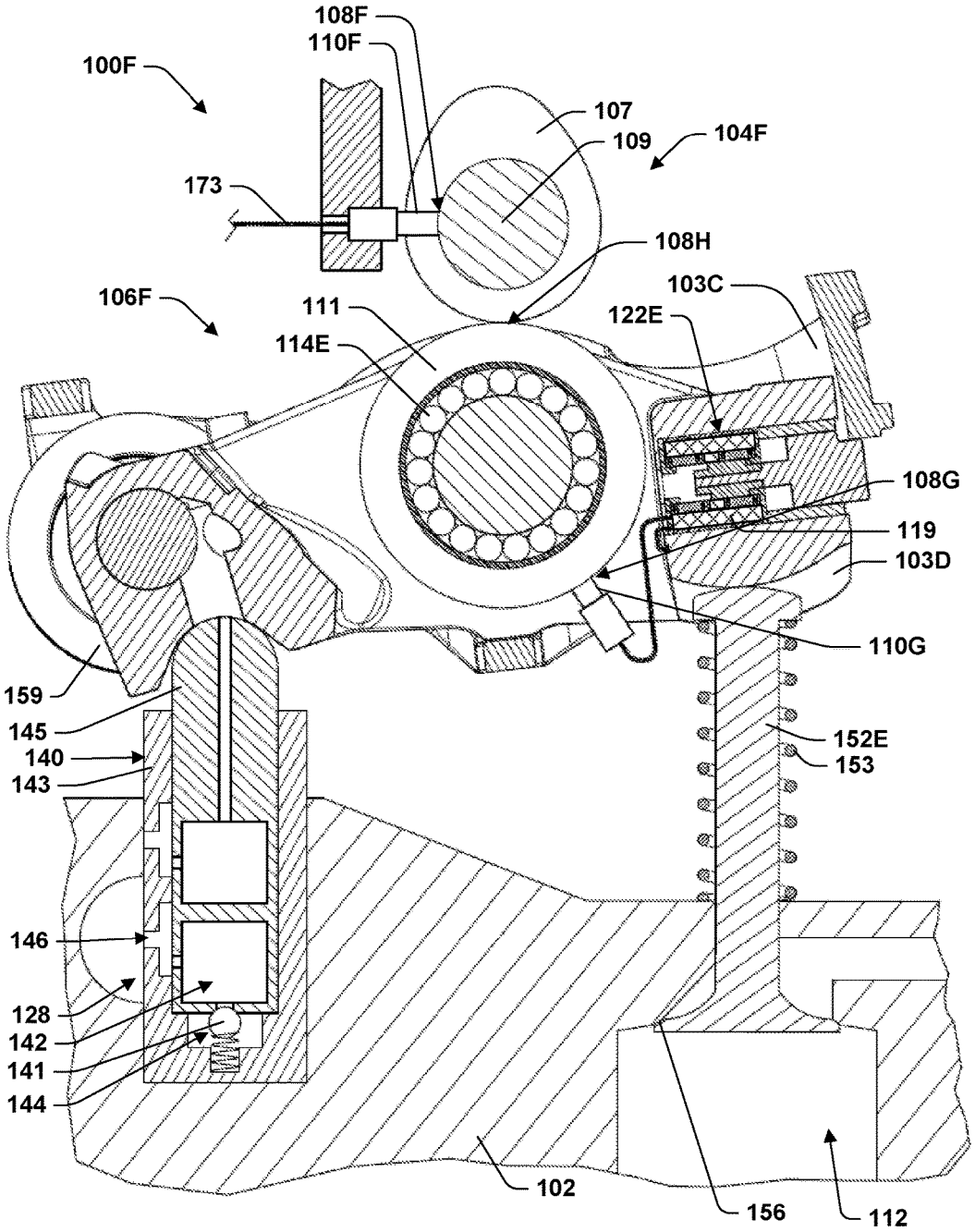
FIG. 19 is a cross-sectional view of a portion of an internal combustion engine including a valvetrain according to some aspects of the present teachings.
Figure 20:
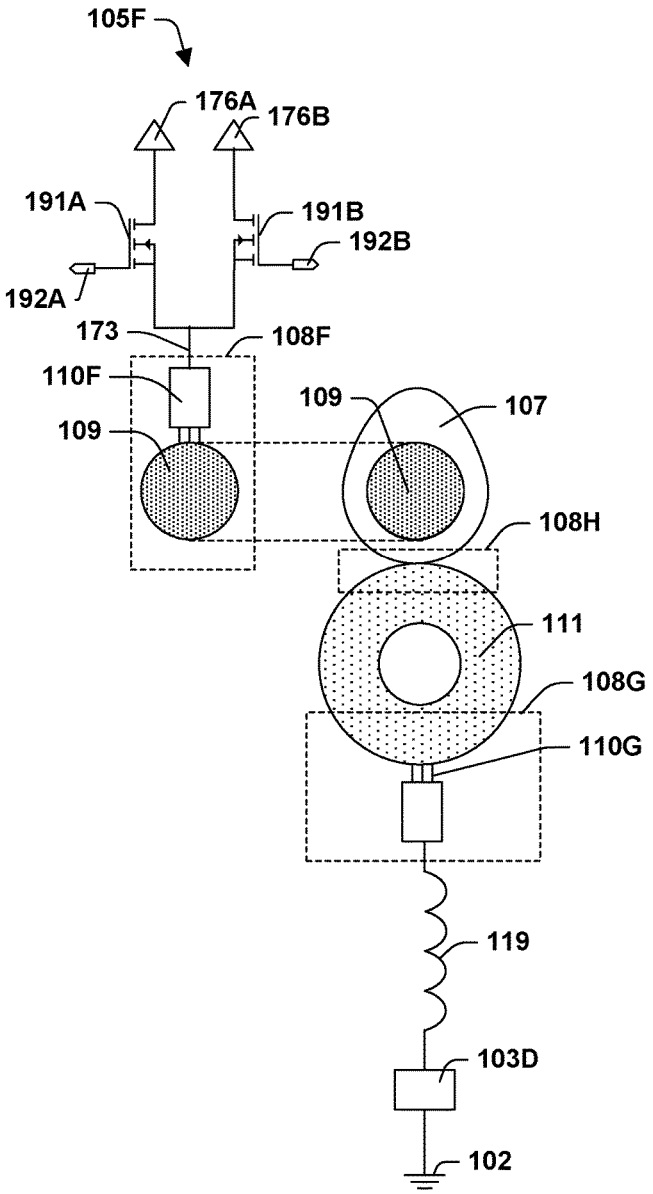
FIG. 20 is a schematic diagram of a circuit according to some aspects of the present teachings that may provide power to a rocker arm-mounted electrical device in the internal combustion engine of FIG. 19.

FIG. 19 illustrates an internal combustion engine 100F that includes a valvetrain 104F having a rocker arm assembly 106F. An electromagnetic latch assembly 122 including coil 119 may be mounted to inner arm 103D of rocker arm assembly 106F. Coil 119 may be powered through an electrical circuit 105F, for which FIG. 20 provides an example schematic diagram. Camshaft 109 may be mounted on dielectric bearings (not shown). Cam roller 111 may be mounted on dielectric bearings 114E. Circuit 105F connects coil 119 to power source 176 through brushes 110F, camshaft 109, cam 107, cam roller 111, and brushes 110G. Circuit 105E includes camshaft 109, cam 107, and cam roller 111, which may be maintained at potentials above or below that of cylinder head 102.

Electrical circuit 105F includes three connections formed by abutting surfaces of distinct parts that undergo relative motion in connection with actuation of cam follower 111. These are electrical connection 108F formed between camshaft 109 and brushes 110F, electrical connection 108H formed between cam 107 and cam roller 111, and electrical connection 108G formed between cam roller 111 and motor brushes 110G, which may be mounted to inner arm 103D.

The internal combustion engines 100 all have end pivot overhead cam (OHC) type valvetrains 104. But the present teaching are generally applicable to internal combustion engines having other types of valvetrains 104 including, for example, other types of OHC valvetrains and overhead valve (OHV) valvetrains. As used in the present disclosure, the term "rocker arm assembly" may refer to any assembly of components that is structured and positioned to actuate a valve 152 in response to rotation of a camshaft 109.

Figure 21:
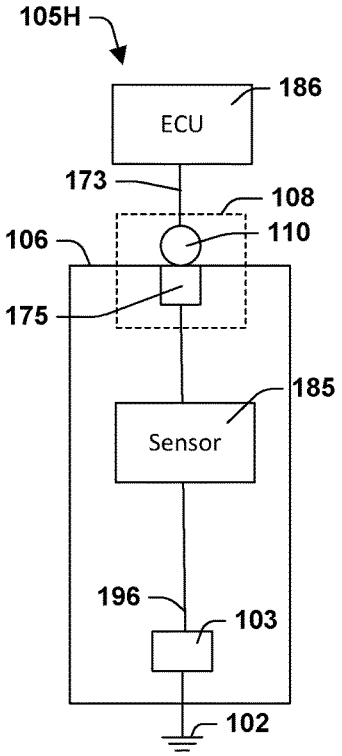
FIG. 21 is a schematic diagram of a variation on other circuits taught by the present disclosure, the variation providing communication with a rocker arm-mounted sensor mounted.

Electrical circuits 105 formed with electrical connections 108 may be used to power or communicate with any suitable type of electronic device mounted to a rocker arm assembly 106. FIG. 21 provide a diagram for an example electrical circuit 105H including an electrical connection 108 through which a sensor 185 mounted to a mobile portion of a rocker arm assembly 106 may communicate with a device mounted to a part distinct from rocker arm assembly 106, such as an engine control unit (ECU) 186. That information may be used for diagnostics or control. In some of these teachings, sensor 185 is a device that does not require external power. Sensor 185 may be, for example, an accelerometer.

Figure 29:
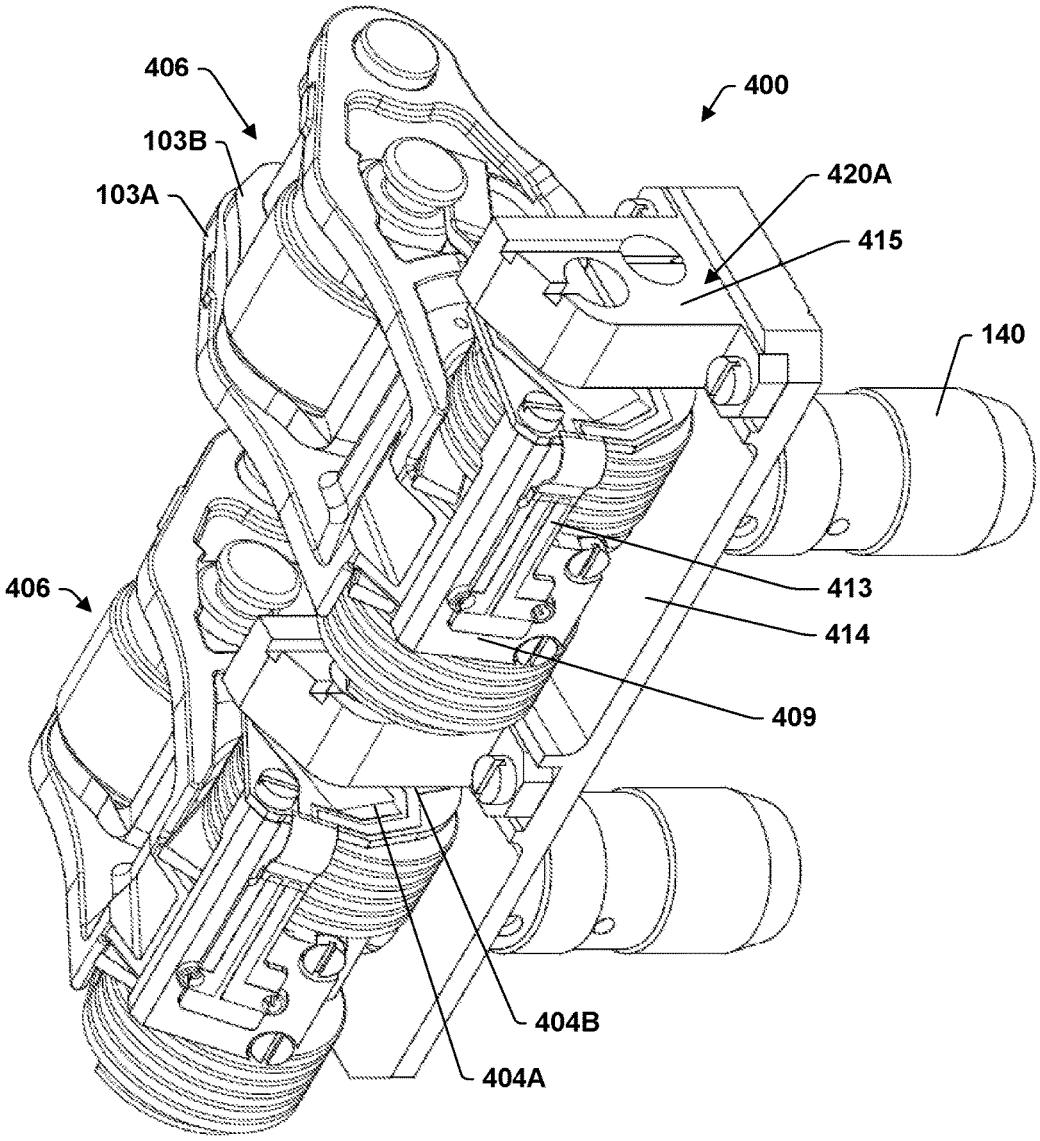
FIG. 29 is a perspective view of a portion of a valvetrain according to some aspects of the present teachings.
Figure 30:
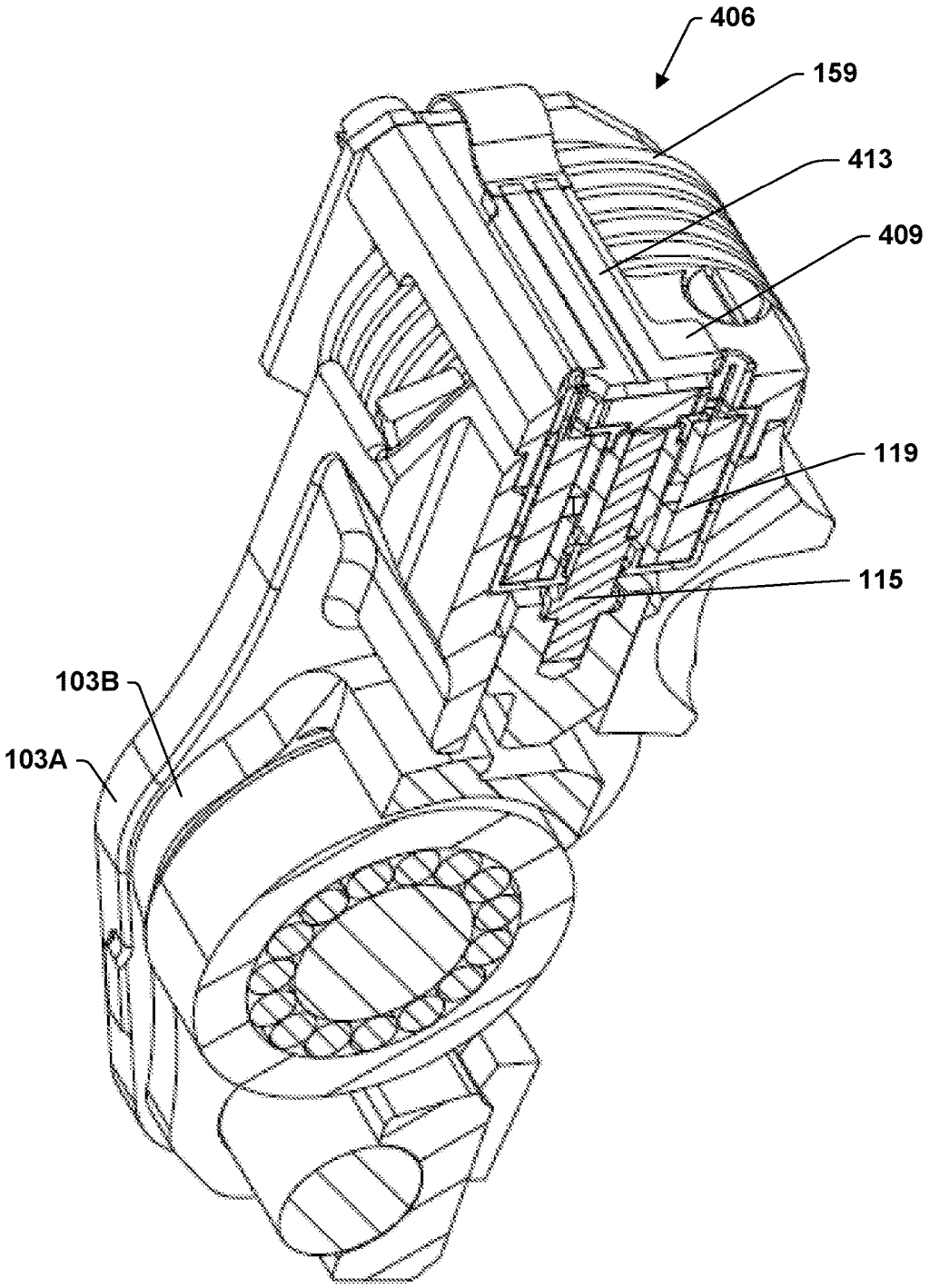
FIG. 30 is another perspective view of the valvetrain of FIG. 29, this view including a cross-section of one of the rocker arm assemblies.
Figure 31:
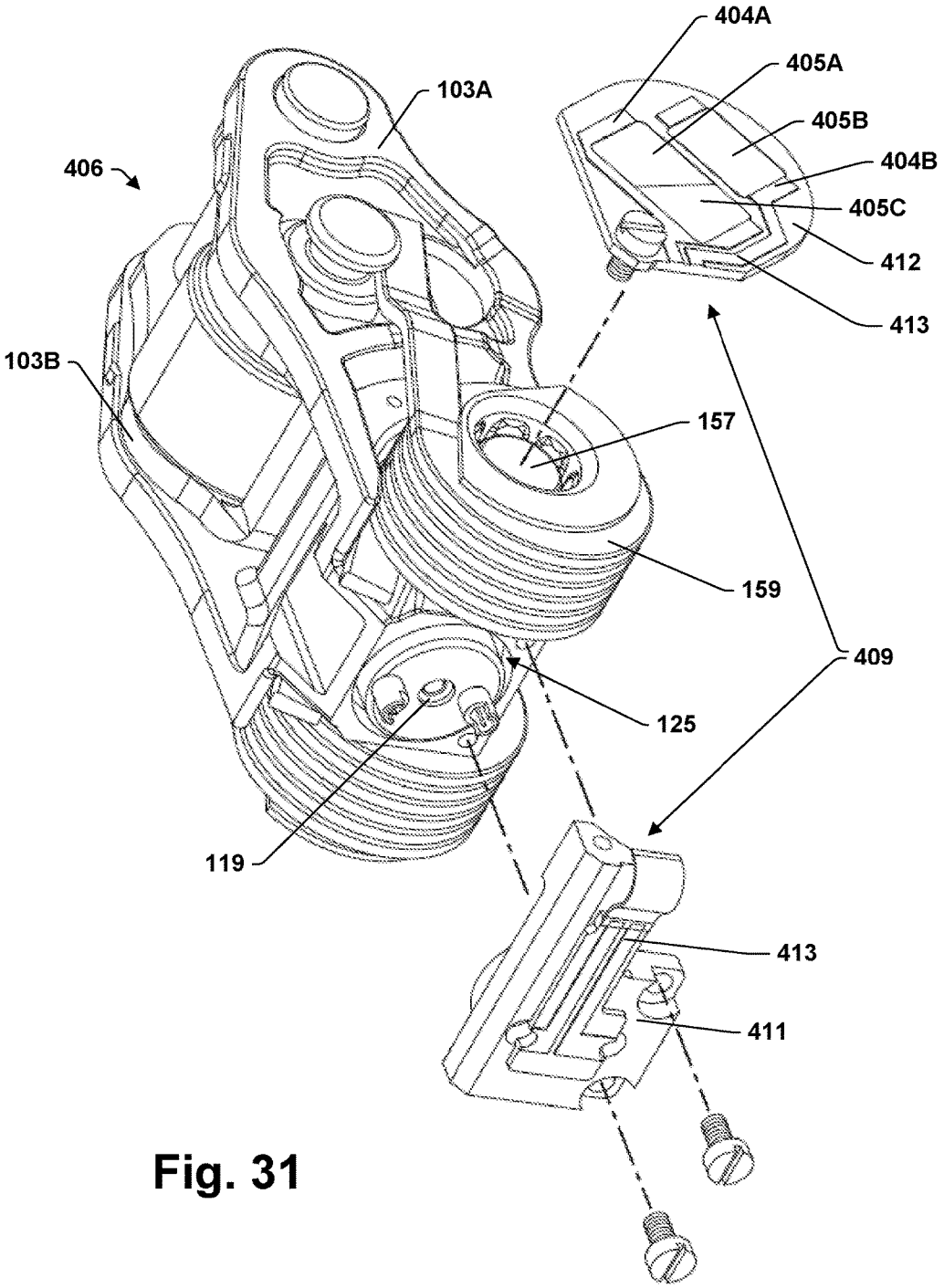
FIG. 31 is a partially exploded view illustrating the way in which contact pads are mounted to a rocker arm assembly of FIG. 29.

FIG. 29-32 illustrates parts of another valvetrain 400 suitable for engine 100. As shown in FIG. 29, valvetrain 400 includes at least two rocker arm assemblies 406 that are generally similar to rocker arm assemblies 106. With further reference to FIGS. 30 and 31, rocker arm assemblies 406 include an outer arm 103A, an inner arm 1036, and contact pads 404A and 404B held to one side of outer arm 103A over spring post 157.

Figure 32:
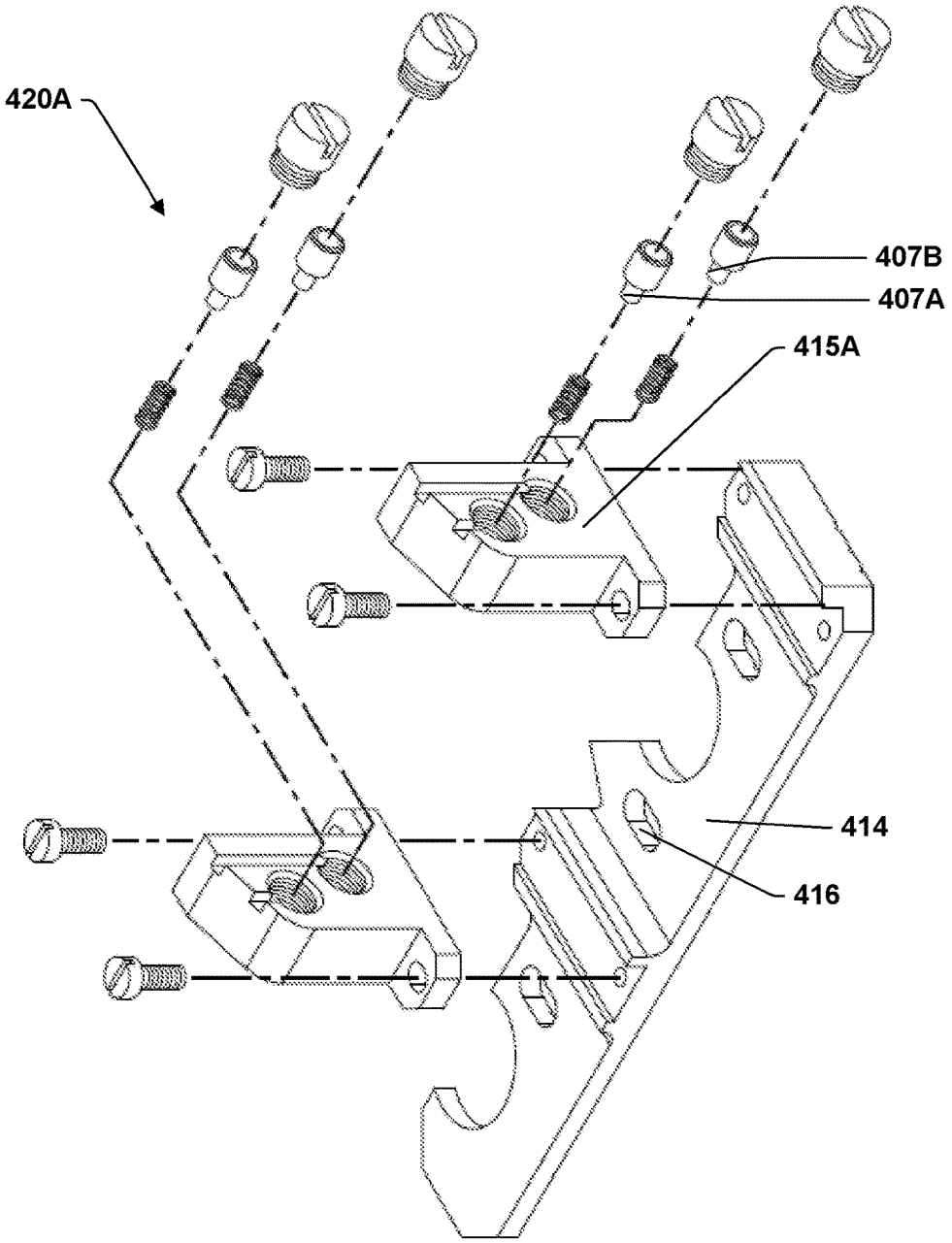
FIG. 32 is an exploded view of a mounting frame for spring loaded contact pins which is part of the valvetrain illustrated in FIG. 29.

Valvetrain 400 further includes a framework 420A that holds spring loaded pins 407A and 407B against contact pads 404A and 404B respectively, at least when rocker arm 103A is on base circle. As shown in FIG. 32, framework 420A includes a base plate 414 and slip ring towers 415A that hold spring loaded pins 407 in abutment with contact pads 404. The abutment completes a circuit that provides power to a coil 119 that is operative to actuate latch pin 115. Contacts pads 404, coil 119, and latch pin 115 are all mounted to outer arm 103A. Wires 413 couple coil 119 to contact pads 404.

With reference to FIG. 31, contact pads 404A and 404B have planar contact surfaces 405A and 405B respectively. Each rocker arm assembly 406 pivots on a pivot 140. Outer arm 103A and inner arm 103B are free to pivot relative to one-another except when they are engaged by latch pin 115. Pivot 140 may raise or lower rocker arm assembly 406 to adjust lash. These motions take rocker arm 103A in directions parallel to the plane in which the planar contact surfaces contact pads 404A and 404B are oriented. Accordingly, the connections between contacts pads 404 and spring-loaded pins 407 may be maintained as outer arm 103A goes through its range of motion.

In some of these teachings, spring loaded pin 407B remains in abutment with contact surface 405B throughout rocker arm 103A's range of motion. In some of these teachings, spring loaded pin 407A remains in abutment with contact surface 405A through only a portion of rocker arm 103A's range of motion. Contact pad 404A may be structured and positioned such that as rocker arm 103A is lifted off base circle, spring loaded pin 407A moved from abutment with contact surface 405A to abutment with contact surface 405C. Connection through contact surface 405C may present a distinctly higher resistance than connection through contact surface 405A. The higher resistance may be provided by a coating on contact surface 405C that is not present on contact surface 405A. In some of these teachings, that coating is a diamond-like carbon (DLC) coating. The difference in resistance may be used to detect the position of rocker arm 103A.

Latch pin 115 may be installed in rocker arm 103A through opening 408 at the back of rocker arms 103A. Coil 119 is also installed in rocker arm 103A through opening 408. Wires 413, which couple coil 119 to contact pads 404, run out of rocker arm 103A through opening 408. Wires 413 continue around the side of rocker arm 103A to connect with contact pads 404. In some of these teachings, wires 413 and contact pads 404 are supported by a bracket 409 that mounts to rocker arm 103A within opening 408.

As shown in FIG. 31, bracket 409 may include a part 411 held at the back of rocker arm 103A and a part 412 held to the side of rocker arm 103A. In some of these teachings, however, parts 411 and 412 are provided as a single part. In some of these teachings, that single part is formed by over-molding wires 413 and contact pads 404. Bracket 409 may be press fit into opening 408.

As shown in FIG. 32, base plate 414 may include cutouts 424 that fit around pivots 140. When framework 420 is installed in engine 100, baseplate 414 may rest atop cylinder head 102 and abut two pivots 140. Cutouts 424 may cooperate with pivots 140 to ensure proper positioning of framework 420 with respect to rocker arm assemblies 406 and therefore proper position of spring loaded pins 407 with respect to contact pads 404. Framework 420 may be secured to cylinder head 102 by bolts passing through openings 416.

Figure 33:
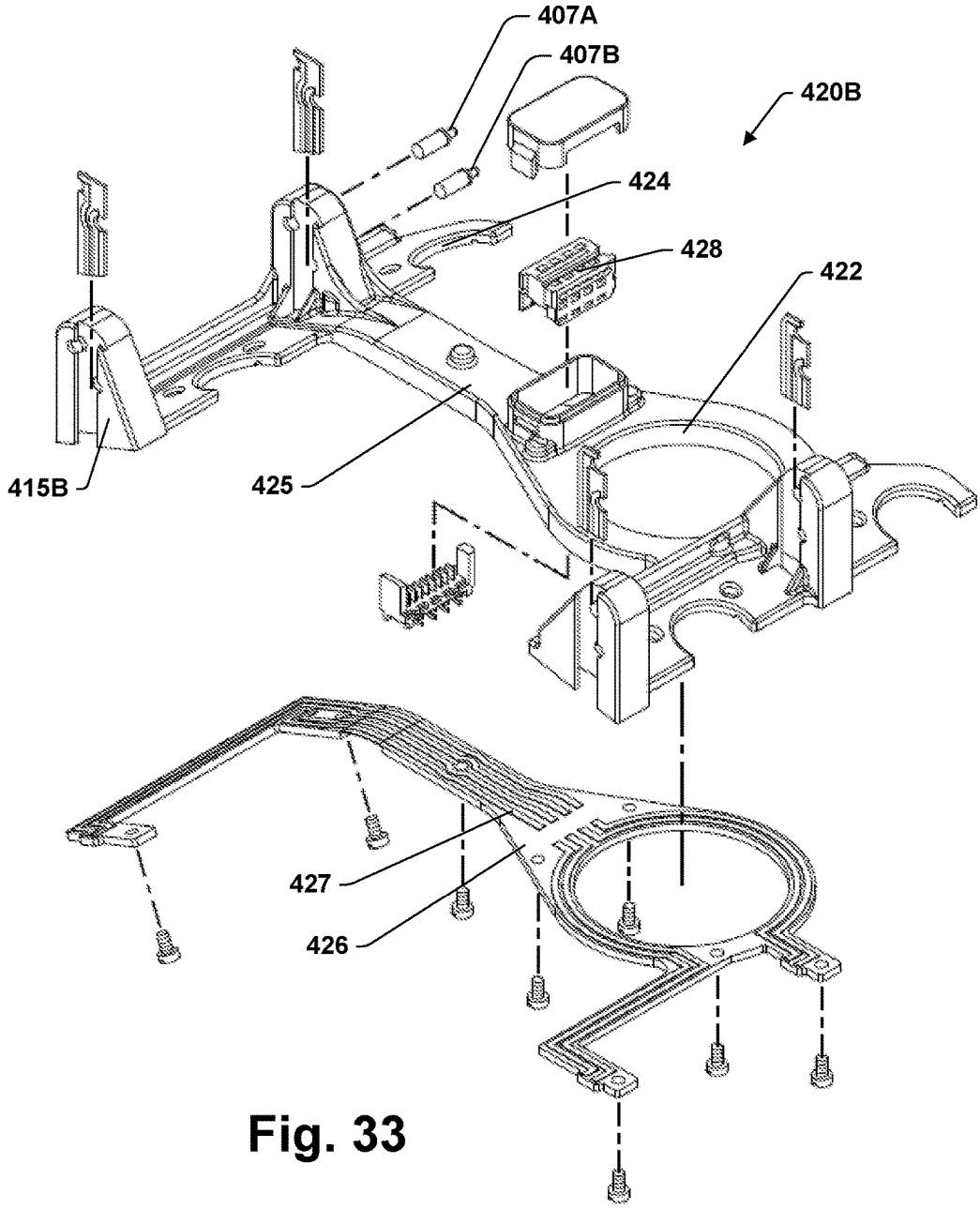
FIG. 33 is an exploded view of a wiring harness according to some aspects of the present teachings.
Figure 34:
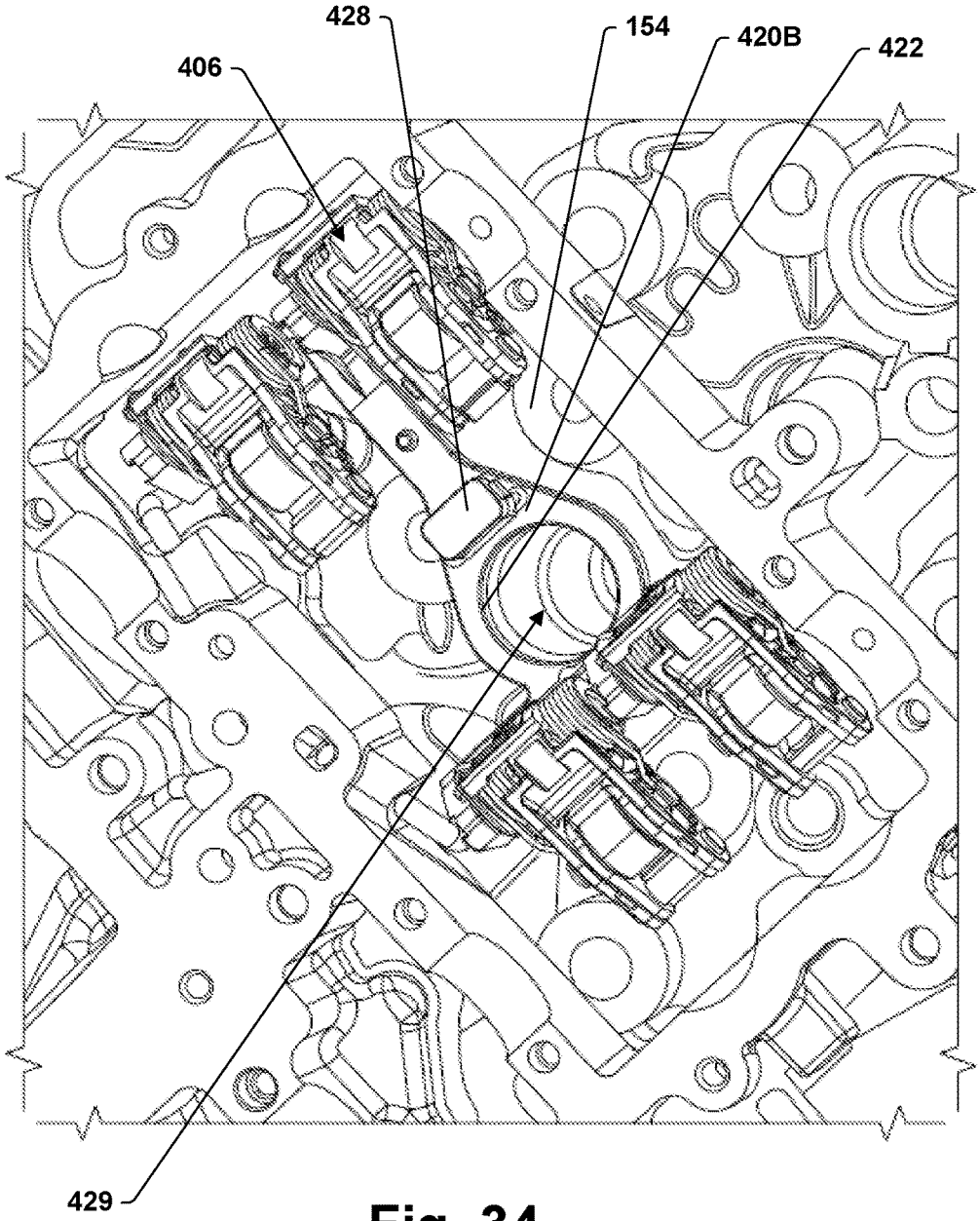
FIG. 34 is a perspective view of a partially manufacture engine in which portions of a valvetrain including the wiring harness of FIG. 33 have been installed.

FIG. 33 illustrates a mounting frame 420B that may be used instead of mounting frame 420A. Mounting frames 420 may be made of plastic. Mounting frame 420B includes an opening 422 that may fit closely around a spark plug tower (not shown) when mounting frame 420B is installed on a cylinder head 102. FIG. 34. shows mounting frame 420B installed on cylinder head 102 with opening 422 positioned above an opening 429 in cylinder head 102 for a spark plug tower. The spark plug tower may be installed before or after frame 420B. Mounting frame 420B may also include four semi-circular cutouts 424 that fit against pivots 140. When engine 100 is fully assembled with frame 420B, a spark plug tower fits through opening 422, cutouts 424 abut pivots 140, and the position of frame 420 is thereby secured. The position of frame 420 may be further secured by fastening frame 420 to cylinder head 102.

As shown in FIG. 33, mounting frame 420B includes an upper part 425 and a lower part 426 that may be fastened together around wires 427 to provide a wiring harness in which wires 427 are isolated from the surrounding environment. Slip ring towers 415B may be attached to frame 420B. Alternatively, frame 420B may include slip ring towers 415B as part of a unitary structure. Slip ring towers 415B support spring loaded pins 407 that make electrical connections between wires 427 and contact pads 404.

As shown in FIG. 34, frame 420B provides a connection plug 428 adjacent a location 429 for a spark plug tower. Plug 428 is for connecting wires 427 to a vehicle power system. The wires from plug 428 may pass through the valve cover (not shown) adjacent the spark plug tower (not shown). Alternatively, those wires may enter the spark plug tower below the valve cover and exit the spark plug tower above the valve cover. A valve actuation module according to the present teachings may be formed by temporarily securing pivots 140 and rocker arm assemblies 406 to frame 420. The valve actuation module is easily installed in engine 100.

Figure 35:
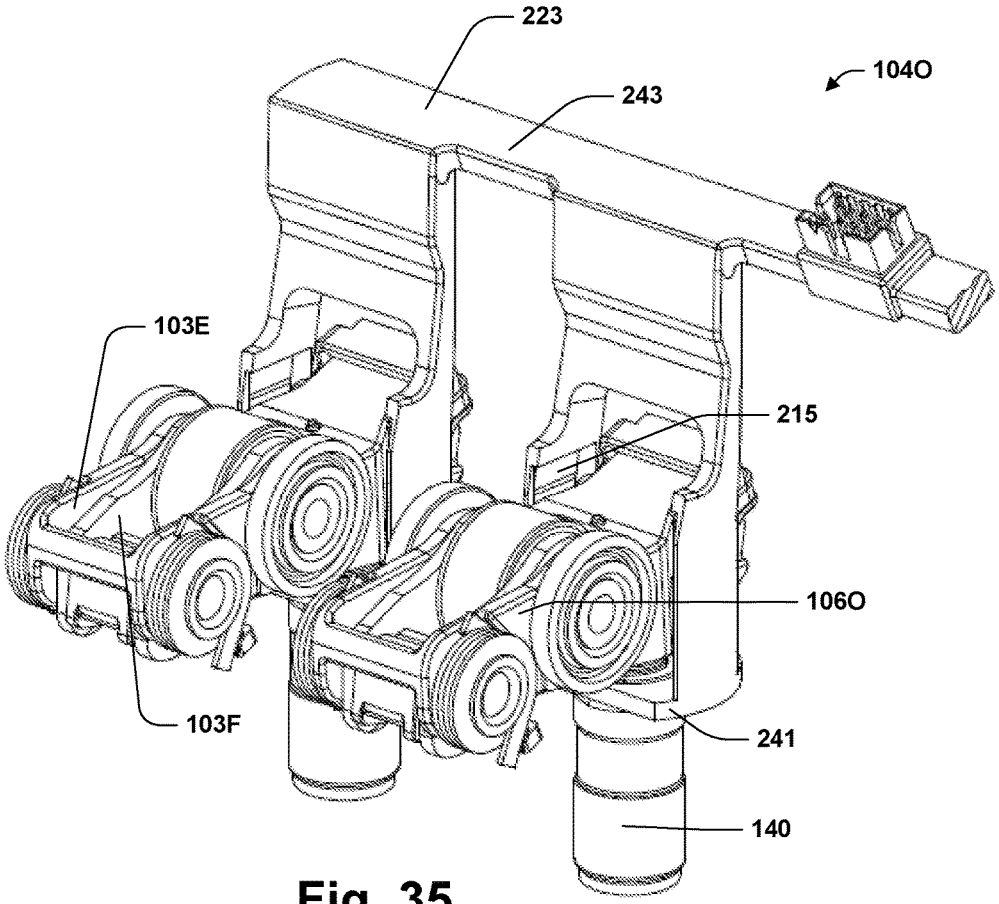
FIG. 35 is a perspective view of a portion of a valvetrain according to some aspects of the present teachings.
Figure 36:
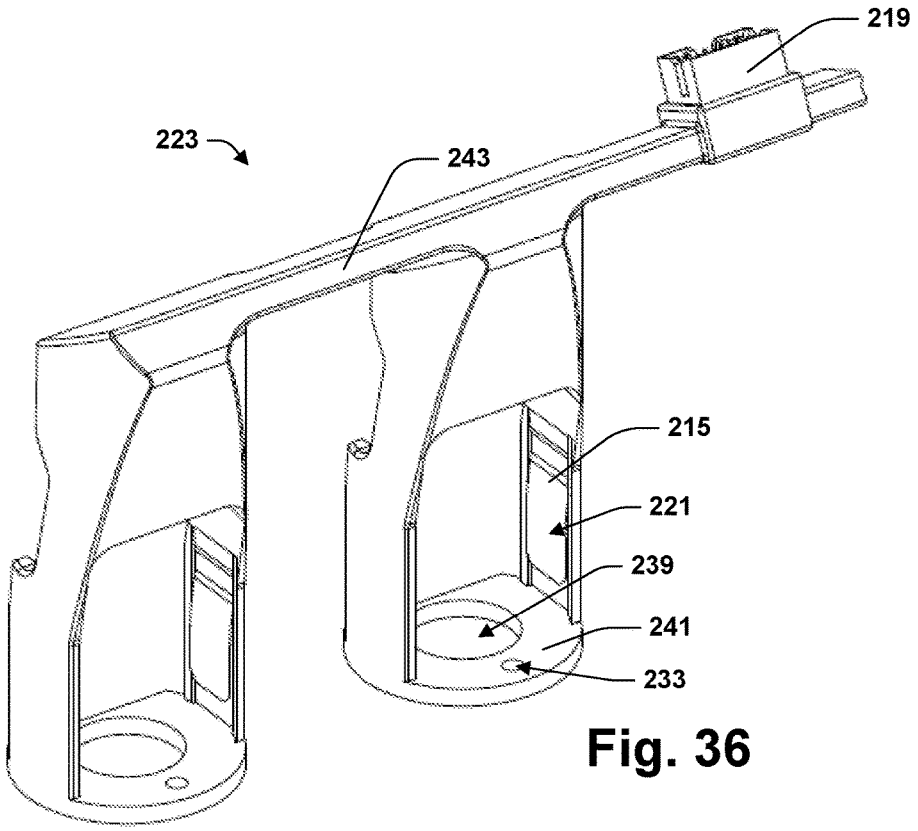
FIG. 36. is a perspective view of a lead frame that holds spring loaded contacts in the valvetrain of FIG. 35.
Figure 37:
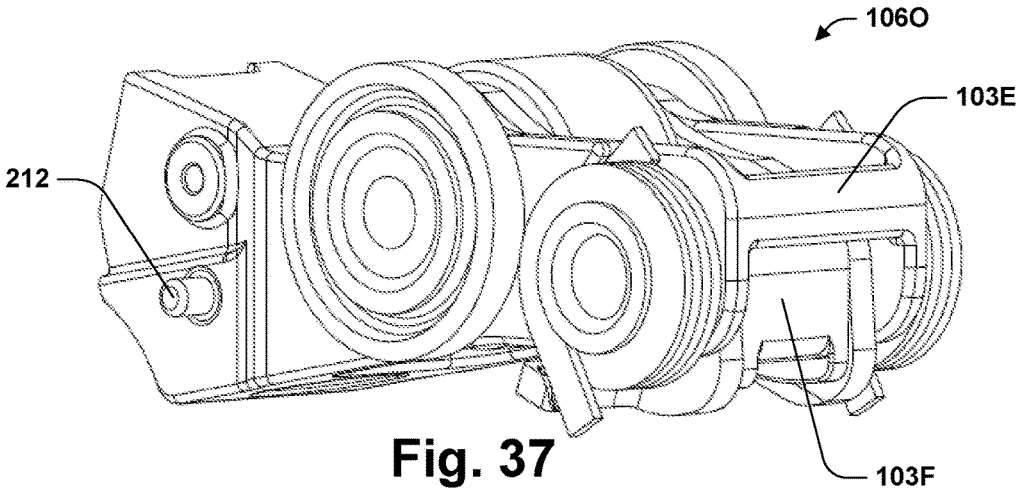
FIG. 37. is a perspective view of one of the rocker arm assemblies in the valvetrain of FIG. 35.
Figure 38:
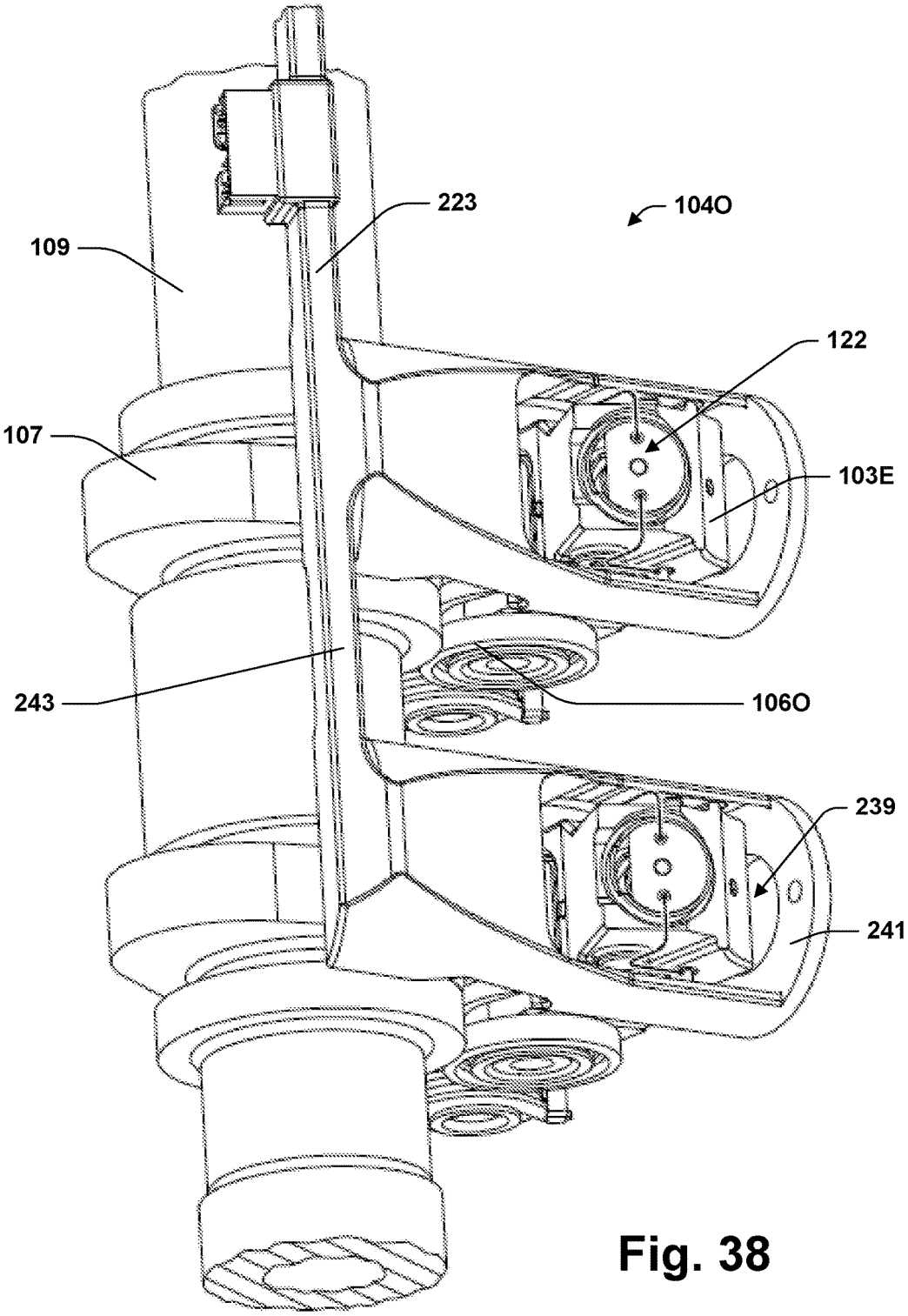
FIG. 38. is another perspective view of the valvetrain of FIG. 35.
Figure 39:
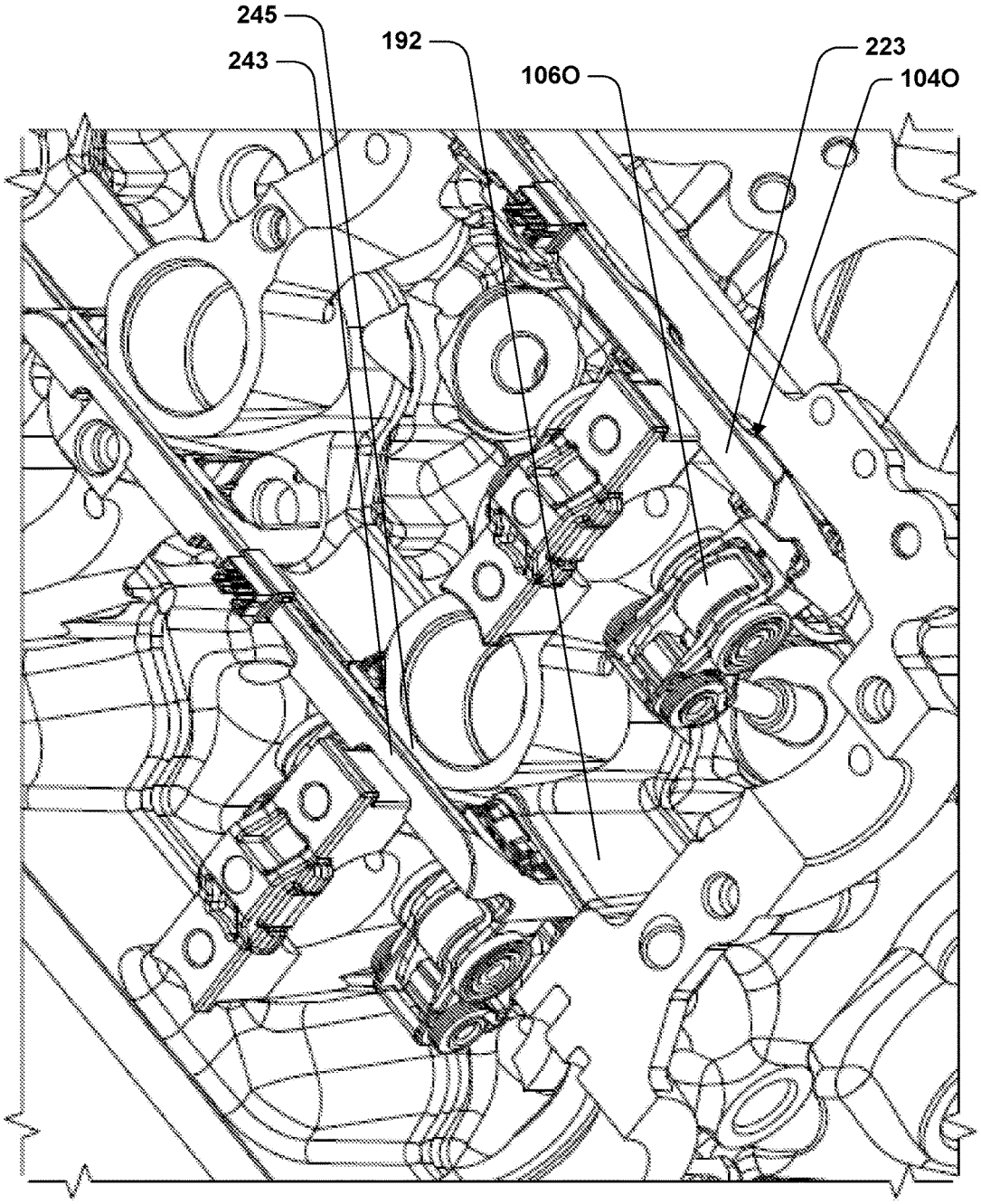
FIG. 39. is perspective view of the valvetrain of FIG. 35 installed in an engine.

FIGS. 35-40 illustrate parts of a valvetrain 104O according to some aspects of the present teachings. FIGS. 35 and 36 provide perspective views of a portion of the valvetrain 104O that includes two rocker arm assemblies 106O, two pivots 140, and a power transfer module 223. A power transfer module, as the term is used in the present disclosure, is a structure that includes an electrical contact and a mounting frame that holds an electrical contact in position adjacent a rocker arm assembly. Power transfer module 223 is shown separately in FIG. 36. A rocker arm assembly 106O is shown separately in FIG. 37. FIG. 39 illustrates parts of valvetrain 104O installed is engine 100. Pivots 140, which may be hydraulic lash adjusters, provide fulcrums for rocker arm assemblies 106O.

Rocker arm assemblies 106O each include two pivotally connected rocker arms 103E and 103F. As shown in FIG. 28, electromagnetic latch assemblies 122 are installed in outer rocker arms 103E. Electromagnetic latch assemblies 122 includes a coil 119 that receives power via contact pins 212, which are mounted to and held one on each side of rocker arm 103E.

Power transfer module 223 includes leaf springs 215. Leaf springs 215 are electrical conductors. Power transfer module 223 is designed to hold leaf springs 215 in abutment with contact pins 212. Electrical connections through which coil 119 may be powered are made between contact pins 212 and leaf springs 215. There may be two electrical connection to each rocker arm 103E, the two connections being made on opposite sides of the rocker arm 103E. Electrical contact may be maintained even as contact pins 212 slide over the surfaces of leaf springs 215 in connection with normal operation of rocker arm assemblies 106O.

Rocker arm assemblies 106O are configured to undergo a pivoting motion as they are actuated by cams 107 (see FIG. 38). This pivoting occurs approximately on an axis. In some of these teachings, contact pins 212 are located proximate that axis to keep the relative motions between contact pins 212 and leaf springs 215 small. The range of motion cams 107 induce on contact pins 212 may be 10% or less the range of motion cams 107 induce on parts of rocker arm assemblies 106O most distant from the axis. In some of these teachings, the range of motion for contact pins 212 is 2% or less the motion induced on the parts of rocker arm assemblies 106O most distant from the axis.

On the other hand, in some of these teachings, a certain range of motion between contact pins 212 and leaf springs 215 is desirable. A portion of the surface of a leaf spring 215 may be coated with a material that significantly increase the resistance of an electrical circuit comprising a connection between contact pin 211 and leaf spring 215. Contact pin 211 may move to that high resistance surface only when cam 107 is lifting rocker arm 103E. The increase in resistance may be detected and used to provide rocker arm position information, which in turn may be used in diagnostic or control operations.

As can be seen in FIG. 36, leaf springs 215 have an outwardly bowed portion 221 adapted to flex against contact pin 211. Power transfer module 223 may be adapted to maintain the bow 221. These adaptations may include structures that hold leaf spring 215 above and below the bowed portion 221. In some of these teachings, power transfer module 223 is over-molded around leaf spring 215, wherein the over-molding secures leaf spring 215 to power transfer module 223.

A connection plug 219 may be positioned at the top of power transfer module 223. Connection plug 219 may be used to couple power transfer module 223 to a vehicle's electrical system. An elevated location such as this, which may be above the heights of rocker arm assemblies 106O, facilitates the coupling with the vehicle's electrical system in that wires connecting to connection plug 219 have a short distance to travel before passing through the valve cover (not shown). The wires may pass through the valve cover adjacent a spark plug tower. One option is to run the wires into and out of a spark plug tower in order that they pass through the valve cover within a spark plug tower.

Power transfer module 223 has a lower portion 241 that rests against cylinder head 102 adjacent pivot 140 and an upper portion 243 that fits over and may rest on a raised portion 245 of cylinder head 102. Raised portion 245 may be above rocker arm assembly 106. "Above" is used in the sense that rocker arm assembly 106O is "above" a combustion chamber formed within cylinder head 102. Power transfer module 223 has openings 239 that fit around pivots 140. Openings 239 abut pivots 140 and help locate power transfer module 223. Openings 239 may fit tightly around pivots 140, whereby pivots 140 may by joined to power transfer module 223 prior to installation. Openings 233 may be formed in lower portion 241 of power transfer module 223 and used to bolt power transfer module 223 to cylinder head 102.

Figure 40:
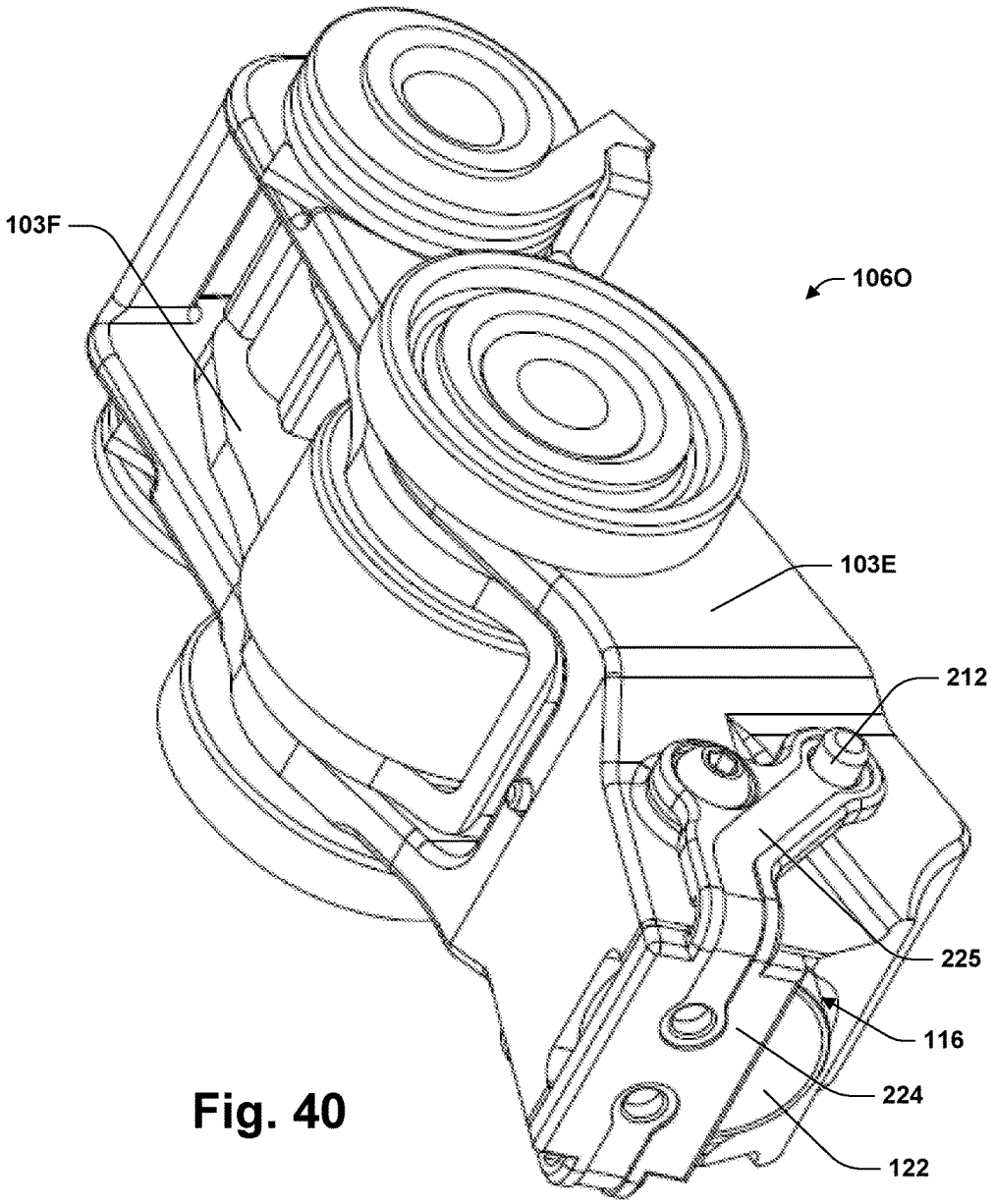
FIG. 40. is a perspective view of the rocker arm assembly of FIG. 37 fit with a contact frame.

FIG. 40 shows rocker arm 106B together with a contact frame 224 that supports contact pins 212 and electrical connections between coil 119 and contact pins 212. The electrical connections are preferably made with stamped metal leads 225. Leads 225 may be joined to contact pins 212 at one end and coil ties off pins at the other. Stamped metal leads 225 may be press fit around or soldered to the pins.

Contact frame 224 may be press fit with an opening 226 through which electromagnetic latch assembly 122 is installed within rocker arm 103E. Contact frame 224 may also be held to the sides of rocker arm 103E. In this example, contact frame 224 is bolted to the sides of rocker arm 103E. Alternatively, support at the sides of rocker arm 103E may be provided by piloting contact pins 212 to the sides of rocker arm 103E. Insulation may prevent short circuiting between a contact pin 212 and rocker arm 103E although this structure without insulation could be used to form a connection to ground.

The components and features of the present disclosure have been shown and/or described in terms of certain embodiments and examples. While a particular component or feature, or a broad or narrow formulation of that component or feature, may have been described in relation to only one embodiment or one example, all components and features in either their broad or narrow formulations may be combined with other components or features to the extent such combinations would be recognized as logical by one of ordinary skill in the art.

The invention claimed is:

1. A valvetrain for an internal combustion engine of a type that has a combustion chamber, a moveable valve having a seat formed in the combustion chamber, and a camshaft, the valvetrain comprising:

a rocker arm assembly comprising a rocker arm and a cam follower configured to engage a cam mounted on the camshaft as the camshaft rotates; and an electrical circuit comprising an electrical device mounted to the rocker arm;

wherein the electrical circuit includes an electrical connection made by abutment between a first surface belonging to a first part and a second surface belonging to a second part; and the rocker arm assembly is operative to move the first surface relative to the second surface in response to actuation of the cam follower.

2. A valvetrain according to claim 1, wherein:

the first part is mounted to the rocker arm; and mountings for the second part consist of mountings to structures that are not part of the rocker arm assembly.

3. A valvetrain according to claim 2, wherein the second part is mounted to a frame that has a base that fits around a pivot that provides a fulcrum for the rocker arm assembly.

4. A valvetrain according to claim 2, wherein the second part is mounted to a frame that has a base that abuts two or more pivots that provide fulcrums for rocker arm assemblies of the valvetrain.

5. A valvetrain according to claim 1, wherein:

the rocker arm assembly is configured to pivot in a plane; and at least one of the first surface and the second surface is parallel to the plane.

6. A valvetrain according to claim 1, further comprising:

a lash adjuster that provides a fulcrum for the rocker arm assembly;

wherein one of the first surface and the second surface runs parallel to a direction in which the lash adjuster extends to adjust lash.

7. A valvetrain according to claim 1, further comprising:

a lash adjuster that provides a fulcrum for the rocker arm assembly;

wherein the first surface and the second surface are configured to slide relative to one another while remaining in contact as the lash adjuster extends and retracts to adjust lash.

8. A valvetrain according to claim 1, further comprising:

a hydraulic lash adjuster that provides a fulcrum for the rocker arm assembly;

wherein the first surface and the second surface are configured to maintain the electrical connection as the hydraulic lash adjuster extends and retracts between pumped up and depressurized states.

9. A valvetrain according to claim 1, wherein:

the rocker arm assembly is configured to pivot on a fulcrum when actuated through the cam follower; and the electrical connection is made proximate the fulcrum.

10. A valvetrain according to claim 1, wherein the electrical connection is isolated from ground.

11. A valvetrain according to claim 1, wherein the electrical device is a coil forming part of an electromagnetic latch assembly.

12. A valvetrain according to claim 11, wherein:

the electromagnetic latch assembly switches the rocker arm assembly between first and second configurations;

in the first configuration, the rocker arm assembly is operative to actuate a moveable valve in response to rotation of the camshaft to produce a first valve lift profile; and in the second configuration, the rocker arm assembly is operative to actuate the moveable valve in response to rotation of the camshaft to produce a second valve lift profile, which is distinct from the first valve lift profile, or the moveable valve is deactivated.

13. A valvetrain according to claim 1, wherein the first surface and the second surface are biased against the each other by a spring.

14. A valvetrain according claim 13, wherein the spring is a leaf spring.

15. A valvetrain according to claim 1, wherein the first part is a contact held to a side of the rocker arm by a contact frame that is supported within an opening at a back end of the rocker arm.

16. A valvetrain according to claim 15, wherein the contact frame is secured to two opposite sides of the rocker arm.

17. A valvetrain according to claim 1, wherein the rocker arm assembly is operative to cyclically break or vary a resistance of the electrical connection in relation to actuation of the cam follower.

18. A valvetrain according to claim 17, wherein one of the first surface and the second surface is operative to abut a third surface to form a second electrical connection over a period when the first surface and the second surface are not abutting.

19. A valvetrain according to claim 17, wherein:

one of the first surface and the second surface is a partially coated surface that is partially coated with a material that increases electrical resistance; and the valvetrain is operable to move the electrical connection between a coated portion of the partially coated surface and an uncoated portion of the partially coated surface, whereby the resistance of the electrical connection varies.

20. A valvetrain according to claim 1, wherein a load-bearing structure of the valvetrain forms a part of the electrical circuit.

21. A valvetrain according to claim 1, wherein the electrical circuit is completed by a mechanical interface between two load-bearing structures of the valvetrain.

22. An internal combustion engine comprising:

a combustion chamber;

a moveable valve having a seat formed in the combustion chamber;

a camshaft; and a valvetrain comprising a rocker arm assembly that comprises a rocker arm and a cam follower configured to engage a cam mounted on the camshaft as the camshaft rotates and an electrical circuit that comprises an electrical device mounted to the rocker arm;

wherein the electrical circuit includes an electrical connection made by abutment between a first surface belonging to a first part and a second surface belonging to a second part;

the rocker arm assembly is operative to move the first surface relative to the second surface in response to actuation of the cam follower; and the first surface and the second surface are electrically isolated from the combustion chamber.

23. The engine of claim 22, wherein:

the first part is mounted to the rocker arm;

the second part is mounted to a frame that has a base that rests against a cylinder head in which the combustion chamber is formed and abuts a pivot that provides a fulcrum for the rocker arm assembly.

24. The engine of claim 23, wherein the frame rests against the cylinder head at a point on the cylinder head that is higher above the combustion chamber than the rocker arm assembly and at a point on the cylinder head that is less high above the combustion chamber than the rocker arm assembly.

25. The engine of claim 22, wherein:

the first surface and the second surface are biased against each other by a leaf spring; and an end of the leaf spring is held stationary relative to the combustion chamber.

26. A method of operating an internal combustion engine of a type that has a combustion chamber, a moveable valve having a seat formed in the combustion chamber, a camshaft on which a cam is mounted, and a valvetrain that includes a rocker arm assembly comprising a rocker arm and a cam follower configured to engage the cam mounted on the camshaft as the camshaft rotates and an electrical circuit comprising an electrical device mounted to the rocker arm and an electrical connection made by abutment between a first surface belonging to a first part and a second surface belonging to a second part, the method comprising:

configuring the electrical connection to cyclically break or vary in resistance in relation to movement of the rocker arm;

actuating the rocker arm assembly using the cam follower;

assessing a status of the electrical connection via the circuit;

monitoring movement of the rocker arm based on the status assessment to acquire information related to movement of the rocker arm; and performing an engine management operation or making a diagnostic determination using the information.

* * * * *